US010011977B2

(12) United States Patent
Guimaraes et al.

(10) Patent No.: US 10,011,977 B2
(45) Date of Patent: Jul. 3, 2018

(54) LOCK ASSEMBLY FOR AN EXCAVATOR WEAR MEMBER

(76) Inventors: Miguel Guimaraes, Mackay (AU); Bruce Lilley, Mackay (AU); Josua Kirsch, Mackay (AU); Edwin Schuetz, Mackay (AU)

( * ) Notice: Subject to any disclaimer, the term of this patent is extended or adjusted under 35 U.S.C. 154(b) by 736 days.

(21) Appl. No.: 14/343,815

(22) PCT Filed: Jun. 14, 2012

(86) PCT No.: PCT/AU2012/000681

§ 371 (c)(1),
(2), (4) Date: Aug. 4, 2014

(87) PCT Pub. No.: WO2013/033751

PCT Pub. Date: Mar. 14, 2013

(65) Prior Publication Data

US 2014/0331529 A1 Nov. 13, 2014

(30) Foreign Application Priority Data

Sep. 8, 2011 (AU) ..... 2011903657
Nov. 21, 2011 (AU) ..... 2011904849
Feb. 27, 2012 (AU) ..... 2012900743

(51) Int. Cl.
*E02F 9/28* (2006.01)

(52) U.S. Cl.
CPC ..... *E02F 9/2833* (2013.01); *E02F 9/2825* (2013.01)

(58) Field of Classification Search
CPC ..... E02F 9/2833; E02F 9/2841; E02F 9/2883; E02F 9/2891; Y10T 24/4578
USPC ..... 70/32–34; 411/549, 553
See application file for complete search history.

(56) References Cited

U.S. PATENT DOCUMENTS 3,774,324 A 11/1973 Lafond
3,839,805 A 10/1974 Stepe
3,982,339 A 9/1976 Nilsson
4,182,058 A 1/1980 Poncin
4,231,173 A 11/1980 Davis
(Continued)

FOREIGN PATENT DOCUMENTS

AU 2003264586 7/2004
AU 2005203574 B2 8/2005
(Continued)

OTHER PUBLICATIONS

International Preliminary Report on Patentability for PCT/AU2012/000681 dated May 29, 2013; 20 pages.
(Continued)

*Primary Examiner* — Matthew D. Troutman

(57) ABSTRACT

A lock assembly, and wear assemblies including wear parts incorporating the lock assembly, having a locking pin with a dowel extending outwardly that is received in a slot of a retaining member. The slot of the retaining member has a narrowed section which is narrowed to a width that is less than the cross sectional dimension of the part of the dowel that is received in the narrowed section. In use, the locking pin is rotated and the dowel traverses the slot of the retaining member including passing through, or at least being received by, the narrowed section of the slot. The slot may optionally have a seat that receives the dowel after passing through the narrowed section.

23 Claims, 32 Drawing Sheets

(56) References Cited

U.S. PATENT DOCUMENTS 4,233,761 A 11/1980 Ryerson
4,235,498 A * 11/1980 Snyder ..... H01R 13/623 439/319
4,305,180 A * 12/1981 Schwartz ..... F16B 21/04 285/396
4,338,736 A 7/1982 Radigan
4,359,256 A * 11/1982 Gallusser ..... H01R 13/623 439/314
4,361,374 A * 11/1982 Marmillion ..... F16B 21/04 439/314
4,404,760 A 9/1983 Hahn
4,481,728 A 11/1984 Mulder et al.
4,587,751 A 5/1986 Sjogren et al.
4,716,668 A 1/1988 Hahn
4,903,420 A 2/1990 Kreitzberg
4,932,478 A 6/1990 Jones
5,088,214 A 2/1992 Jones
5,172,501 A 12/1992 Pippins
5,256,077 A * 10/1993 Mattingly ..... H01R 13/625 285/396
5,272,824 A 12/1993 Cornelius
5,337,495 A 8/1994 Pippins
5,423,138 A 6/1995 Livesay et al.
5,469,648 A 11/1995 Jones
5,653,048 A 8/1997 Jones
5,709,043 A 1/1998 Jones
5,718,070 A 2/1998 Ruvang
5,918,391 A 7/1999 Vinas Peya
5,937,550 A 8/1999 Emrich
5,956,874 A 9/1999 Ianello
6,018,896 A 2/2000 Adamic
6,052,927 A 4/2000 Pippins
6,108,950 A 8/2000 Ruvang
6,119,378 A 9/2000 Pippins
6,439,796 B1 8/2002 Ruvang
6,467,203 B2 10/2002 Pippins
6,467,204 B1 10/2002 Creighton
6,735,890 B2 5/2004 Carpenter
6,959,506 B2 11/2005 Adamic
7,100,315 B2 9/2006 Carpenter
7,178,274 B2 2/2007 Emrich
7,707,755 B2 * 5/2010 Lopez Almendros E02F 9/2825 172/772
7,762,015 B2 7/2010 Smith et al.
9,033,610 B2 * 5/2015 Lopez Almendros E02F 9/2825 37/457
9,469,974 B2 10/2016 Guimaraes
2002/0000053 A1 1/2002 Adamic et al.
2003/0070330 A1 4/2003 Olds et al.
2004/0016153 A1 * 1/2004 Pippins ..... E02F 9/2875 37/456
2004/0139632 A1 7/2004 Robinson
2006/0189218 A1 * 8/2006 Uhari ..... G04G 17/08 439/752
2007/0209189 A1 * 9/2007 Lopez Almendros E02F 9/2825 29/525.01
2007/0256335 A1 11/2007 De Martiis
2010/0170119 A1 7/2010 Lopez Almendros et al.
2012/0260539 A1 * 10/2012 Guimaraes ..... E02F 9/2833 37/452
2012/0260540 A1 * 10/2012 Guimaraes ..... E02F 9/2833 37/453
2014/0223784 A1 * 8/2014 Endersby ..... E02F 9/2833 37/456
2015/0275485 A1 * 10/2015 Almendros ..... E02F 9/2825 37/457

FOREIGN PATENT DOCUMENTS

AU 2009238226 B2 4/2009
CA 2161505 4/1997
WO 2004/027272 A2 4/2004
WO 2008/116942 A1 10/2008
WO 2009/127016 A1 10/2009
WO 2011/069183 6/2011
WO 2013/033751 A1 3/2013

OTHER PUBLICATIONS

International Search Report for PCT/AU2012/000681 dated Aug. 20, 2012; 4 pages.
Written Opinion of the International Searching Authority for PCT/AU2012/000681 dated Aug. 20, 2012; 4 pages.

* cited by examiner

LOCK ASSEMBLY FOR AN EXCAVATOR WEAR MEMBER

CROSS REFERENCE TO RELATED APPLICATION

The present application is a national phase entry under 35 U.S.C. § 371 of International Application No. PCT/AU2012/000681, filed Jun. 14, 2012, entitled "A LOCK ASSEMBLY FOR AN EXCAVATOR WEAR MEMBER," which designated, among the various States, the United States of America, and which is hereby incorporated by reference.

FIELD OF THE INVENTION

The invention relates to a lock assembly for an excavator wear member. In particular, although not exclusively, the invention relates to a lock assembly for releasably securing an excavator tooth to a nose of an excavator.

BACKGROUND TO THE INVENTION

Excavator tooth assemblies mounted to the digging edge of excavator buckets and the like generally comprise a replaceable digging tooth, an adaptor body and an adaptor nose which is secured by welding or the like to the digging edge of a bucket or the like. The tooth generally has a socket-like recess at its rear end to receivably locate a front spigot portion of the adaptor nose and a removable locking pin is generally employed to releasably secure the tooth on the adaptor.

In use, excavator teeth are subjected to extensive load forces along a longitudinal axis of a tooth as well as in vertical and transverse directions. A snug fit is required between the digging point and the front portion of the adaptor and also between the adaptor socket and the nose spigot portion and their respective mounting pins to avoid premature wear between the components. As the various components wear, the locking pins can loosen thereby increasing the risk of loss of a digging point or an entire adaptor/tooth combination. This necessitates considerable downtime to replace the lost wear members and where items such as locking pins are not recovered, these can cause damage and/or further downtime in downstream operations such as ore crushing and the like.

The greatest loads experienced by excavator tooth assemblies are vertical loads which tend to generate large moment forces capable of rotating a tooth off the front of an adaptor and/or rotating the adaptor off the adaptor nose. In addition, twisting or "yaw" loads are frequently imposed on such tooth assemblies.

Despite many prior art attempts to improve the mounting of a wear member to a nose, of an excavator, most of these proposals suffer from one or more deficiencies.

One common problem is the difficulty in removing a wear member for replacement due to fines build up. The fines may compact and cement in the locking mechanism which can seize certain locking mechanism. This can be more prevalent when operating in certain conditions or when handling certain materials that produce particular fines. In certain cases fines build up can render the locking mechanism inoperable, and considerable time and effort may then be required to remove the wear member and locking mechanism by other means.

As described hereinafter, many of the prior art references relate to direct mounting of a tooth onto a nose without an intermediate adaptor but in those assemblies, the mounting systems for securing teeth directly onto excavator noses is considered analogous to the mounting of a tooth onto an adaptor.

U.S. Pat. No. 4,182,058 describes an excavator tooth having a rearwardly divergent tapering socket to receive a nose having a complementary-shaped front spigot portion. Resistance to rotational moment forces is borne by a resilient steel cotter pin extending through aligned vertical apertures in the socket and spigot portions.

U.S. Pat. Nos. 3,774,324, 4,338,736, 4,481,728, 4,903,420, 5,469,648, 7,100,315 and 6,735,890 all describe nose and tooth combinations wherein the nose has a generally convergently tapering spigot portion with a forward tip having a box-like configuration with at least the upper and lower surfaces thereof having faces parallel to each other and to a longitudinal axis of the nose portion. With the exception of U.S. Pat. No. 4,338,736, which describes a transverse locking pin, each of the tooth mounting arrangements is heavily reliant on a large vertical locking pin to resist rotational moment forces tending to rotate the teeth off respective noses.

U.S. Pat. No. 4,231,173 describes a tapered adaptor nose having a box-like free end, which engages in a mating box-like socket cavity to resist rotational moments. Opposed pairs of rearwardly extending tongues engage in corresponding recesses in the outer surfaces of the adaptor nose to resist rotational movements. Because the tongues themselves are unsupported, they possess a limited capacity to resist rotational moment forces.

U.S. Pat. No. 5,272,824 describes a structure similar to that of U.S. Pat. No. 4,231,173 except that the side tongues are of more robust dimensions and the upper and lower tongues are formed as box-like members with apertures to receive a vertical mounting pin passing through aligned apertures in the tooth and adaptor nose.

U.S. Pat. No. 4,404,760 provides flat rail surfaces on the adaptor nose to engage with mating grooves in the socket aperture of a corresponding tooth wherein the mating rail and groove surfaces are generally parallel to the longitudinal axis of the tooth.

U.S. Pat. No. 5,423,138 describes a generally tapered nose having a box-like front end with upper and lower transverse surfaces generally parallel to a longitudinal axis of a tooth which located directly thereon. The parallel upper and lower transverse surfaces are contiguous with upper and lower rail surfaces on each side of the nose and parallel to the longitudinal axis of the tooth. A pair of rearwardly extending side tongues locate in recesses formed in the outer side faces of the nose, ostensibly to resist rotational moment forces in the tooth. Because the side tongues are recessed to accommodate the side rail portions, the robustness of the side tongues is somewhat compromised.

U.S. Pat. No. 4,233,761 describes a fairly stubby tapered nose having a box-like front portion with upper and lower surfaces generally parallel to a longitudinal axis of an excavator tooth, an intermediate rearwardly diverging tapered portion and a rear portion having upper and lower surfaces extending generally parallel to a longitudinal axis of the tooth. Formed on the upper and lower surfaces of the front, intermediate and rear portions of the nose are spaced parallel reinforcing ribs which are located in mating grooves in the excavator tooth. A large vertical locking pin extends through aligned apertures in the tooth and nose between the reinforcing ribs. This structure is heavily reliant on the locking pin to resist rotational moment forces however it is considered that this configuration may be prone to failure in the rear portion of the adaptor.

U.S. Pat. No. 5,709,043 describes a nose/adaptor combination wherein the adaptor socket tapers convergently towards a box-like front portion having upper and lower bearing surfaces generally parallel to a longitudinal axis of the tooth, a front transverse upright bearing surface and rearwardly divergent bearing surfaces formed at obtuse angles between the converging upper and lower walls and the side walls of the socket, ostensibly to avoid areas of stress concentration.

U.S. Pat. No. 6,018,896 describes a pin/retainer system for locking an excavation tooth onto an adaptor wherein the retainer is inserted in the adaptor and a wedge-shaped pin is driven into aligned apertures in the tooth and adaptor to resiliently engage with the retainer.

United States Publication No. U.S. 2002/0000053A1 describes a mechanism for releasably retaining an adaptor into the nose of a bucket lip or the like wherein a tapered threaded socket is non-rotatably located on the inside of an aperture in the side wall of the adaptor. A threaded retaining pin extends through the threaded socket and locates in an aligned aperture in the bucket nose.

U.S. Pat. No. 5,337,495 describes a tooth assembly with a two-piece telescopically engageable adaptor secured to a nose with a tapered wedge pin assembly. A similar mounting system is described in U.S. Pat. Nos. 5,172,501 and 6,052,927. Other retention systems for digging points on adaptors or adaptors on noses are described in U.S. Pat. Nos. 6,119,378, 6,467,204, and 6,467,203.

Other devices for removably securing replaceable wear elements on earth working equipment such as a retaining pin, a bolt, a pin lock and locking blocks engageable in a top aperture in a wear member are described in U.S. Pat. Nos. 3,839,805, 3,982,339, 4,587,751, 5,088,214 and 5,653,048 respectively.

U.S. Pat. No. 5,937,550 describes a lock assembly for releasably securing an adaptor to a nose of an excavator support structure. The lock assembly comprises a body and a base coupled together and adapted for insertion, while coupled together, in a hole in the nose of the support structure. The length of the lock assembly is extended to secure the adaptor and is retracted to release the adaptor. While adequate for securing an adaptor to a nose of an excavator support structure, the lock described in this patent is relatively complex in design and operation leading to high costs and labour intensive extraction procedures in the field.

Canadian Patent Application No. 2,161,505 describes a system for removably retaining an excavation point on an adaptor with at least one flanged sleeve having a screw-threaded aperture therein, the flanged sleeve being non-rotatably locatable in a transverse bore in the adaptor before fitment of the point onto the adaptor. A screw-threaded pin is inserted into the sleeve via an aperture in the point whereby portion of the head of the pin retains the point on the adaptor.

Australian Patent Application No. 2003264586 describes a locking pin assembly comprising a body member having a non-circular cross sectional shape locatable in a bore of complementary shape extending laterally between opposite sides of an excavator lip mounting nose. After locating the body member in the nose aperture, an adaptor can be engaged over the nose with apertures in opposite side walls aligned with the body member. Threaded bolts engage in threaded apertures in opposite ends of the body member, the bolts each having a tapered shank portion with an enlarged boss at a free end thereof, the boss being locatable in a respective aperture in a side wall of said adaptor to prevent the adaptor from disengaging with the nose.

While generally satisfactory for their intended purpose, the abovementioned prior art all suffer from one or more shortcomings or disadvantages in terms of inadequate resistance to rotation of a tooth off a nose or an adaptor under the influence of vertical loads applying a rotational moment to the tooth, a predisposition to premature wear, difficulties in retention of the teeth on noses or adaptors, difficulties in removing teeth from noses or adaptors due to fines build up after use, inadequate locking systems and unduly complicated configurations giving rise to increased fabrication costs. Furthermore, the prior art all generally rely on lock assemblies that require threaded components. Thread components in lock assemblies are generally disadvantageous as dirt and fines can infiltrate the threaded assembly thereby causing cementation and resulting in difficulties in removal.

OBJECT OF THE INVENTION

It is an object of the invention to overcome or at least alleviate one or more of the above problems and/or provide the consumer with a useful or commercial choice.

DISCLOSURE OF THE INVENTION

In one form, although it need not be the only or indeed the broadest form, the invention resides in a lock assembly for an excavator wear assembly, the lock assembly comprising:

a locking pin having at least one dowel extending outwardly therefrom;

a retaining member having a slot adapted to receive the dowel;

wherein a narrowed section of the slot is narrowed to a width that is less than the cross sectional dimension of the part of the dowel received in the narrowed section of the slot.

Suitably, the slot may have a seat adapted to receive the dowel after passing through the narrowed section, the seat having a width which is larger than the width of the narrowed section of the slot. In a form, the seat width is preferably the same or larger than the width of the part of the dowel passing through the narrowed section.

In a form the slot may taper from a width at least the same as the width of the part of the dowel passing therethrough to a width which is less than the width of the part of the dowel passing therethrough. A plurality of seats may define at least one narrowed section. Preferably the seats decrease in size towards the narrow end of the tapered slot.

At least one seat is preferably provided that is sized larger than the narrowed section preceding it but not sized greater than the part of the dowel passing through the narrowed section. The seat may be sized smaller than the part of the dowel passing through the narrowed section such that the dowel is held under pressure when located in the seat.

The dowel may extend fully into the slot or may only extend partially into the slot.

The retaining member preferably has a cylindrical aperture through which the locking pin is received. The slot is preferably located in a wall of the retaining member defining the aperture. The narrowed section of the slot preferably extends orthogonally to the longitudinal axis of the cylindrical aperture and/or is narrowed axially with respect to the cylindrical aperture.

The slot preferably follows a helical path with decreasing pitch from an entrance opening to at least the narrowed section. The slot preferably ends in a terminal wall which, in a form, may have one or more cut-outs. A cut-out is preferably located in the junction of the terminal wall with an upper or lower guide surface. Preferably a cut-out is located in each junction of the terminal wall with the upper and the lower guide surfaces.

Suitably, the seat forms part of the slot. A seat is preferably located near the terminal wall of the slot such that when a dowel is located in the seat a portion of the dowel engages with a portion of the terminal wall.

Suitably, the slot is adapted to receive the dowel when the locking pin is axially rotated such that the dowel is forced along the slot and the dowel resiliently deforms the narrowed sections to allow passage therethrough in order to allow the dowel to be captured within the seat.

Alternatively, the dowel resiliently deforms to allow passage through the narrowed sections.

Optionally; both the dowel and the material forming the retaining member in the vicinity of the narrowed section resiliently deform.

In still a further form, the invention resides in an excavator wear assembly comprising:

an excavator wear member having a socket cavity and locking aperture extending through a side wall of the excavator wear member, the locking aperture having a receiving passage and a retaining recess;

a locking pin having at least one dowel extending outwardly therefrom;

a retaining member located within the retaining recess of the locking aperture, the retaining member having a slot adapted to receive the dowel, a narrowed section of the slot narrowed to a width that is less than the cross sectional dimension of the part of the dowel received in the narrowed section of the slot; and an adaptor having a spigot portion located within the socket cavity of the excavator wear member and a retaining passage;

wherein the locking pin is located through the locking aperture of the excavator wear member and the retaining passage of the adaptor and wherein the slot is adapted to receive the dowel when the locking pin is axially rotated such that the dowel is forced into the narrowed section of the slot. The dowel may be captured within a seat after being forced through the narrowed section of the slot. A plurality of seats may be provided, preferably of decreasing size. When located in a seat, the dowel may be contained under pressure.

In still a further form, the invention resides in an excavator wear member comprising:

a locking aperture extending through a side wall of the excavator wear member, the locking aperture having a receiving passage and a retaining recess; and a retaining member located within the retaining recess of the locking aperture, the retaining member having a slot and a narrowed section. The narrowed section of the retaining member is narrowed to a width that is less than the cross sectional dimension of a part of a dowel of a locking pin that may be received in the narrowed section of the slot.

Preferably, the slot is adapted to receive a dowel of a locking pin and the narrowed section of the slot is configured to be narrowed to a width that is less than the cross sectional dimension of the part of the dowel. The slot may have a seat adapted to receive the dowel after passing through the narrowed section. In a form, the slot may be tapered with a plurality of slots.

Optionally, the retaining member is integrally formed within the retaining recess.

Further features of the present invention will become apparent from the following detailed description.

BRIEF DESCRIPTION OF THE DRAWINGS

To assist in understanding the invention and to enable a person skilled in the art to put the invention into practical effect preferred embodiments of the invention will be described by way of example only with reference to the accompanying drawings, wherein.

Figure 13:
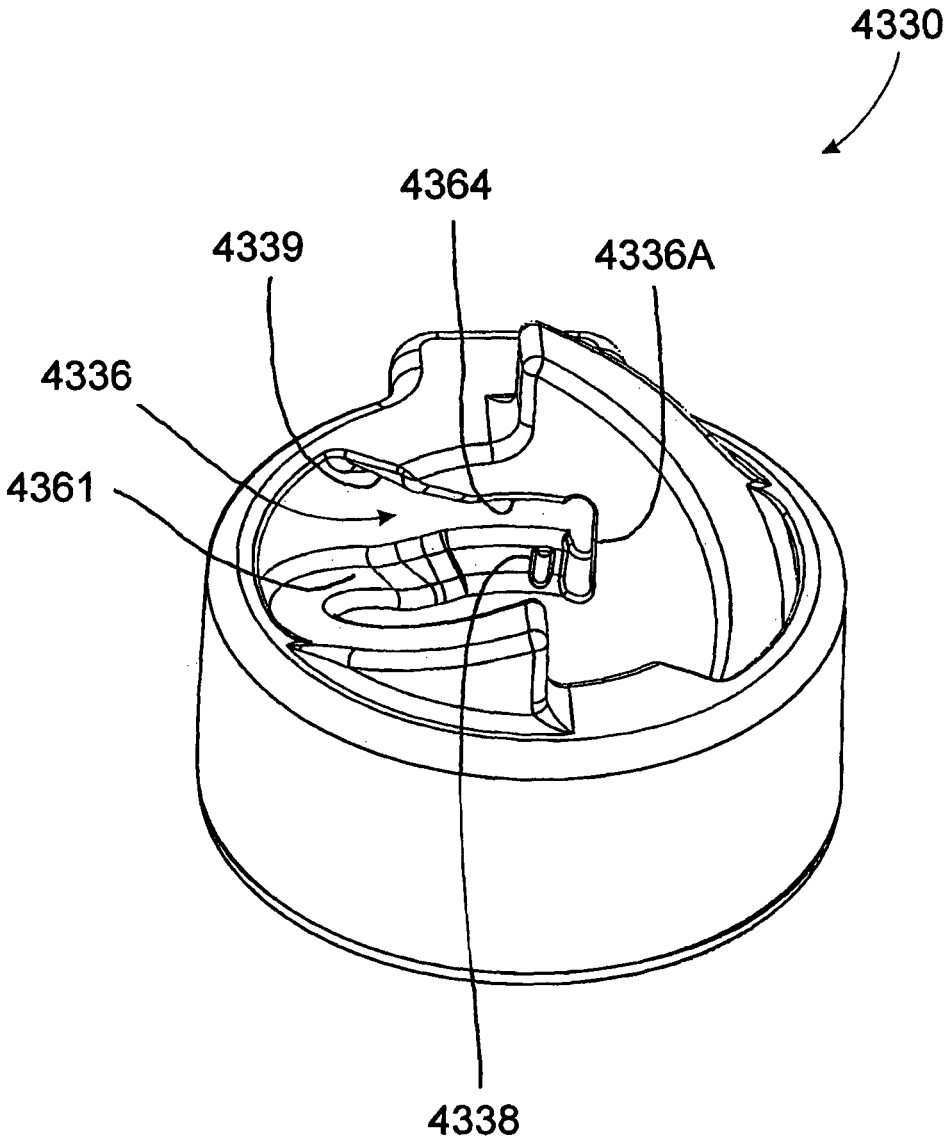
Figure 14:
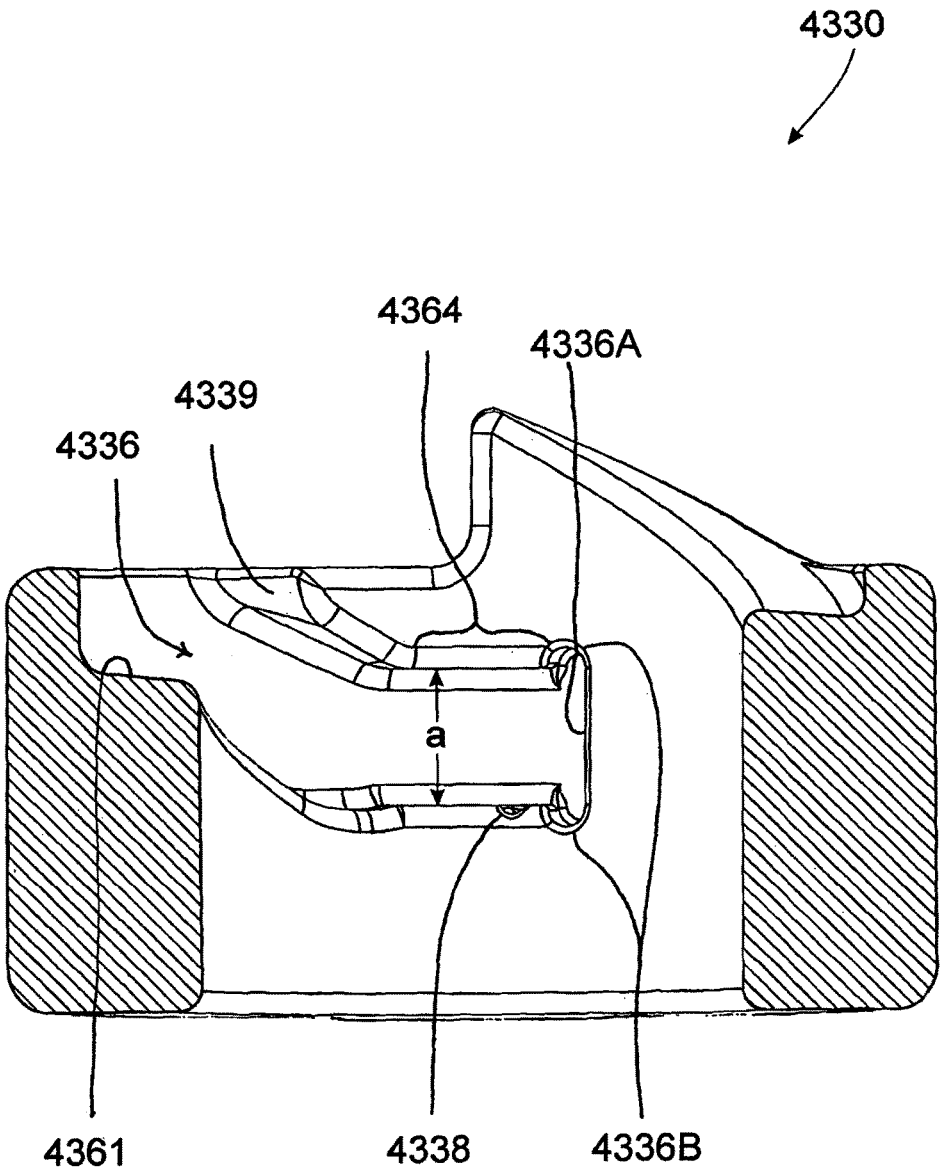

13 shows a perspective view of a retaining member according to yet another embodiment of the invention;

FIG. 14 shows a sectional view of the retaining member shown in FIG. 13.

DETAILED DESCRIPTION OF THE INVENTION

The excavator wear assembly and lock assembly therefore are described with reference to an excavator wear member in the form of a tooth releasably secured-to an adaptor. The adaptor is in turn secured to a nose of an excavator bucket or the like. A skilled addressee will appreciate that the invention may be employed to releasably secure an adaptor to a nose or a tooth directly to a nose of an excavator bucket lip.

Furthermore, the lock assembly may be utilized in other applications such as a retaining pin for components in dragline excavator rigging and the like.

Figure 1A:
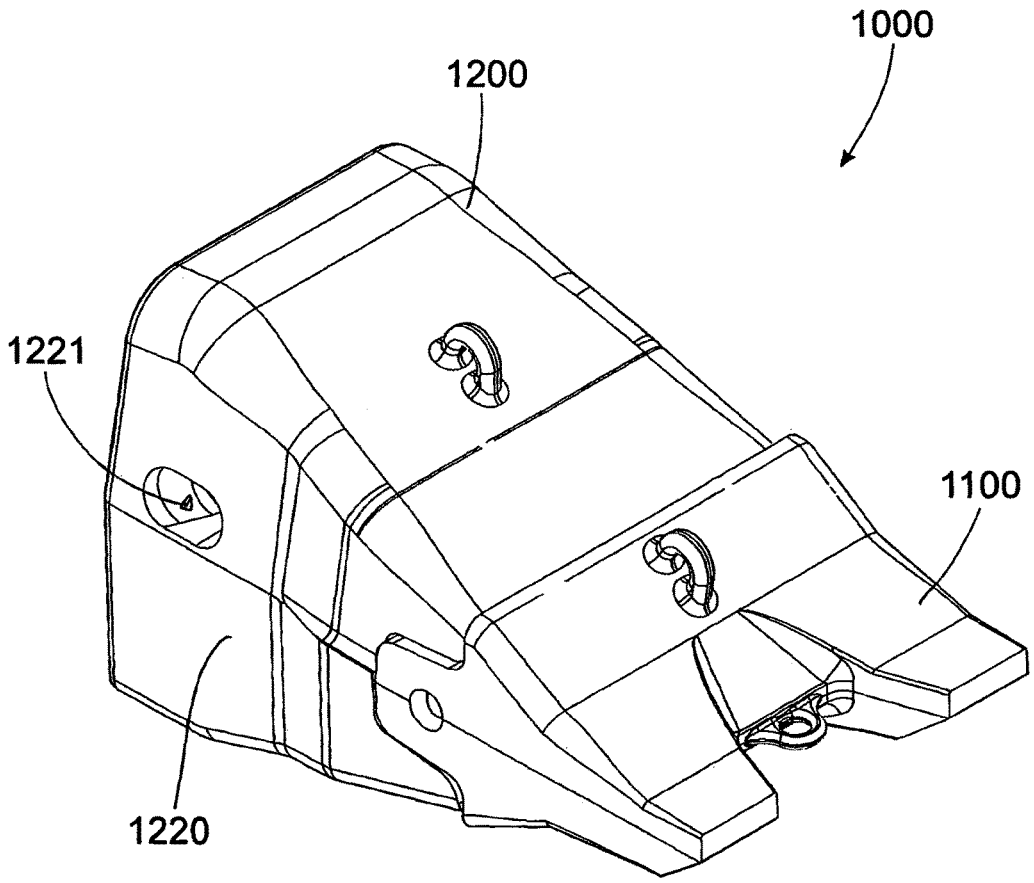
FIG. 1A shows a perspective view of an excavator wear assembly according to an embodiment of the invention.
Figure 1B:
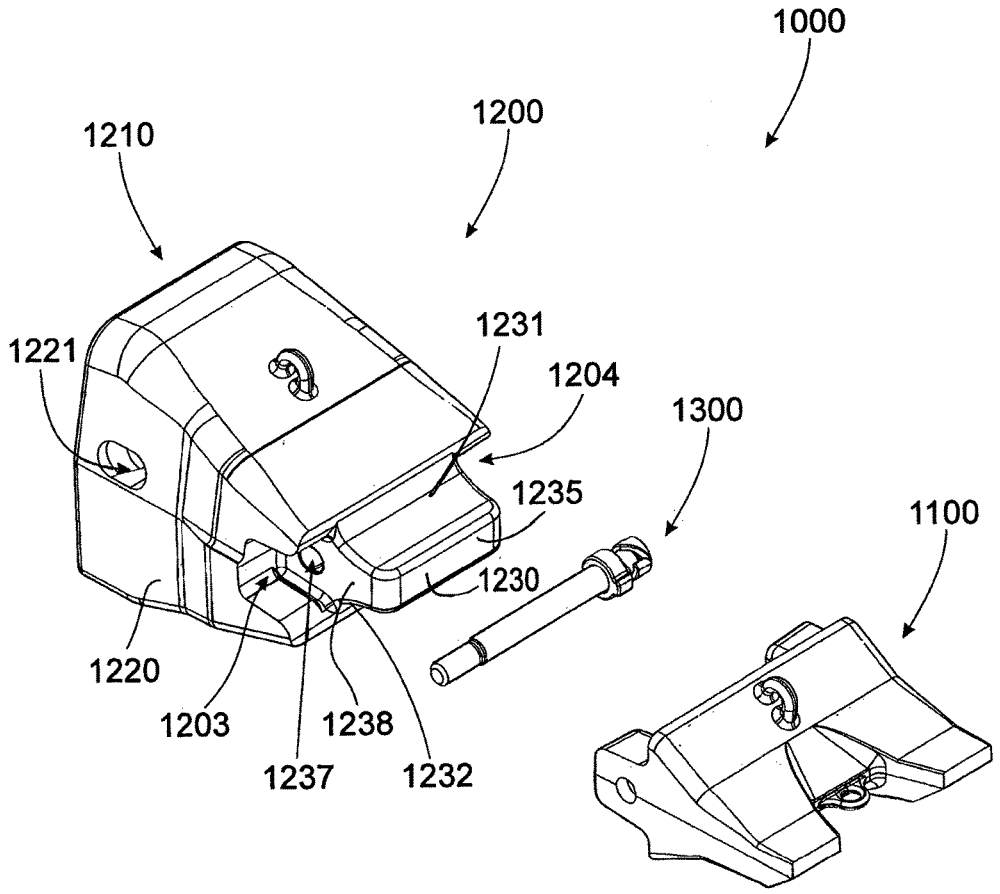
FIG. 1B shows an exploded perspective view of the excavator wear assembly shown in FIG. 1A.

FIG. 1A shows a perspective view of an excavator wear assembly 1000 according to an embodiment of the invention. FIG. 1B shows an exploded perspective view of the excavator wear assembly 1000. Excavator wear assembly 1000 comprises a wear member in the form of a tooth 1100 mountable on an adaptor 1200 and a lock assembly 1300 adapted to releasably secure tooth 1100 on adaptor 1200 as will be discussed in greater detail below.

Adaptor 1200 is suitably configured for mounting on a digging edge of an excavator by way of an adaptor socket 1210. Adaptor socket 1210 is formed in a shape complimentary with a nose of an excavator digging edge (not shown).

Adaptor 1200 has aligned transverse apertures 1221 each extending through a respective opposed side wall 1220. Aligned transverse apertures 1221 are adapted to receive an adaptor retaining pin (not shown) which extends through aligned transverse apertures 1221 and an adaptor retaining pin passage in the complimentary shaped nose (not shown) to thereby retain the adaptor 1200 on the excavator digging edge.

Additionally, adaptor 1200 has a pair of side wall mounting recesses 1203 and 1204 located in a forward portion of respective opposed side wall 1220.

Adaptor 1200 further includes a spigot portion 1230 extending from a forward portion thereof. Spigot portion 1230 has converging upper and lower rear bearing surfaces 1231, 1232 which terminate at substantially parallel upper and lower forward bearing surfaces 1233, 1234 respectively. A front bearing face 1235 is disposed between upper forward bearing surface 1233 and lower forward bearing surface 1234.

Spigot portion 1230 also has a retaining passage 1237 extending therethrough between opposed side walls 1236 thereof.

Figure 2A:
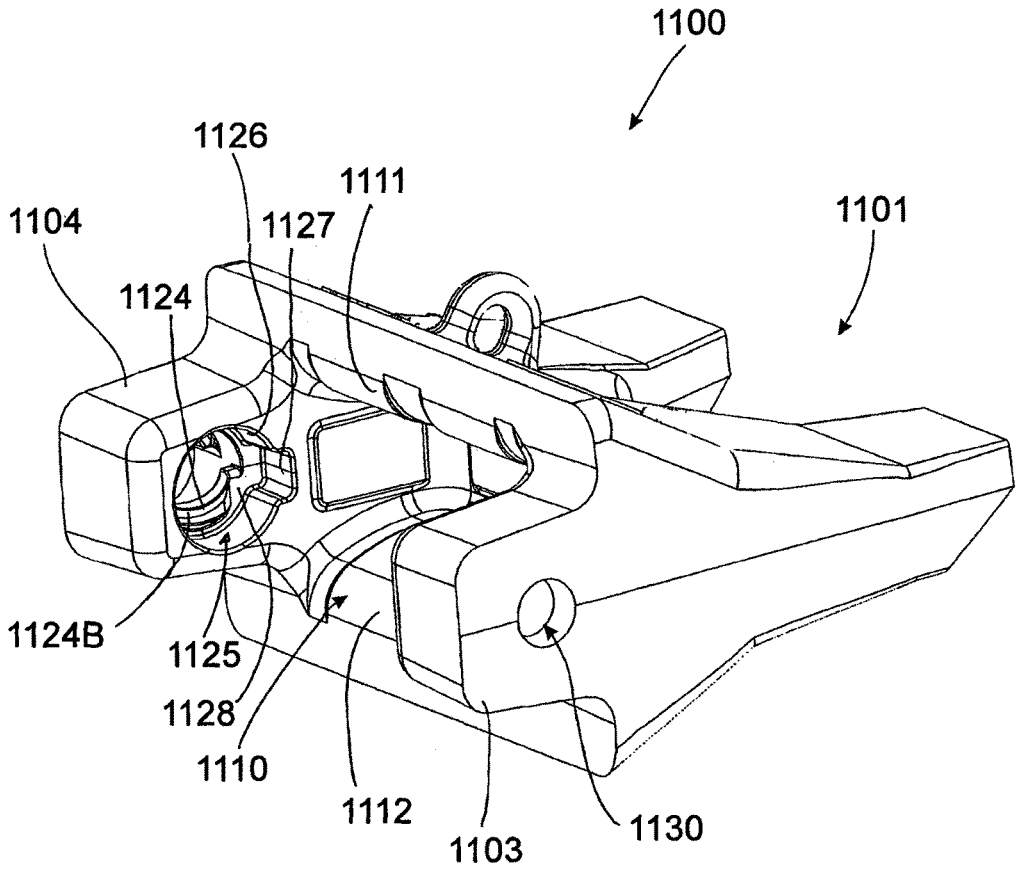
FIG. 2A shows a reverse perspective view of a tooth forming part of the excavator wear assembly shown in FIG. 1A.
Figure 2B:
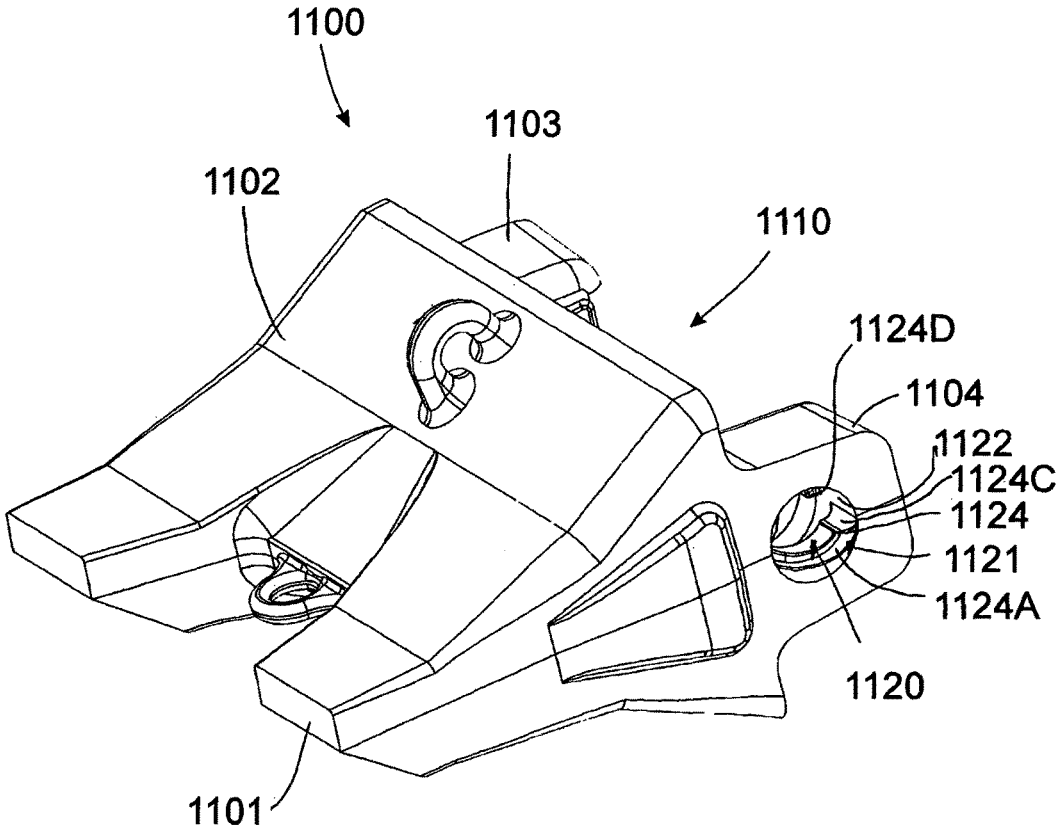
FIG. 2B shows a front perspective view of the tooth shown in FIG. 2A.
Figure 2C:
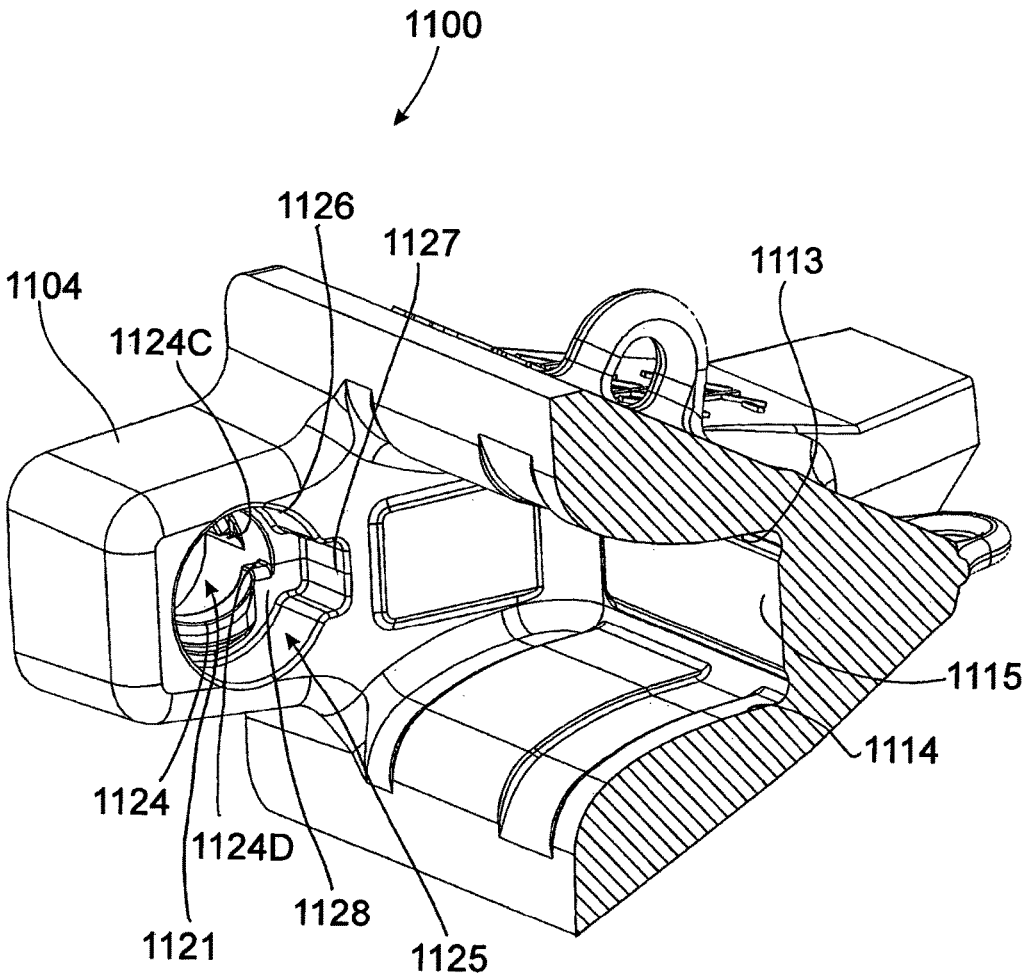
FIG. 2C shows a sectional perspective view of the tooth shown in FIG. 2A.
Figure 2D:
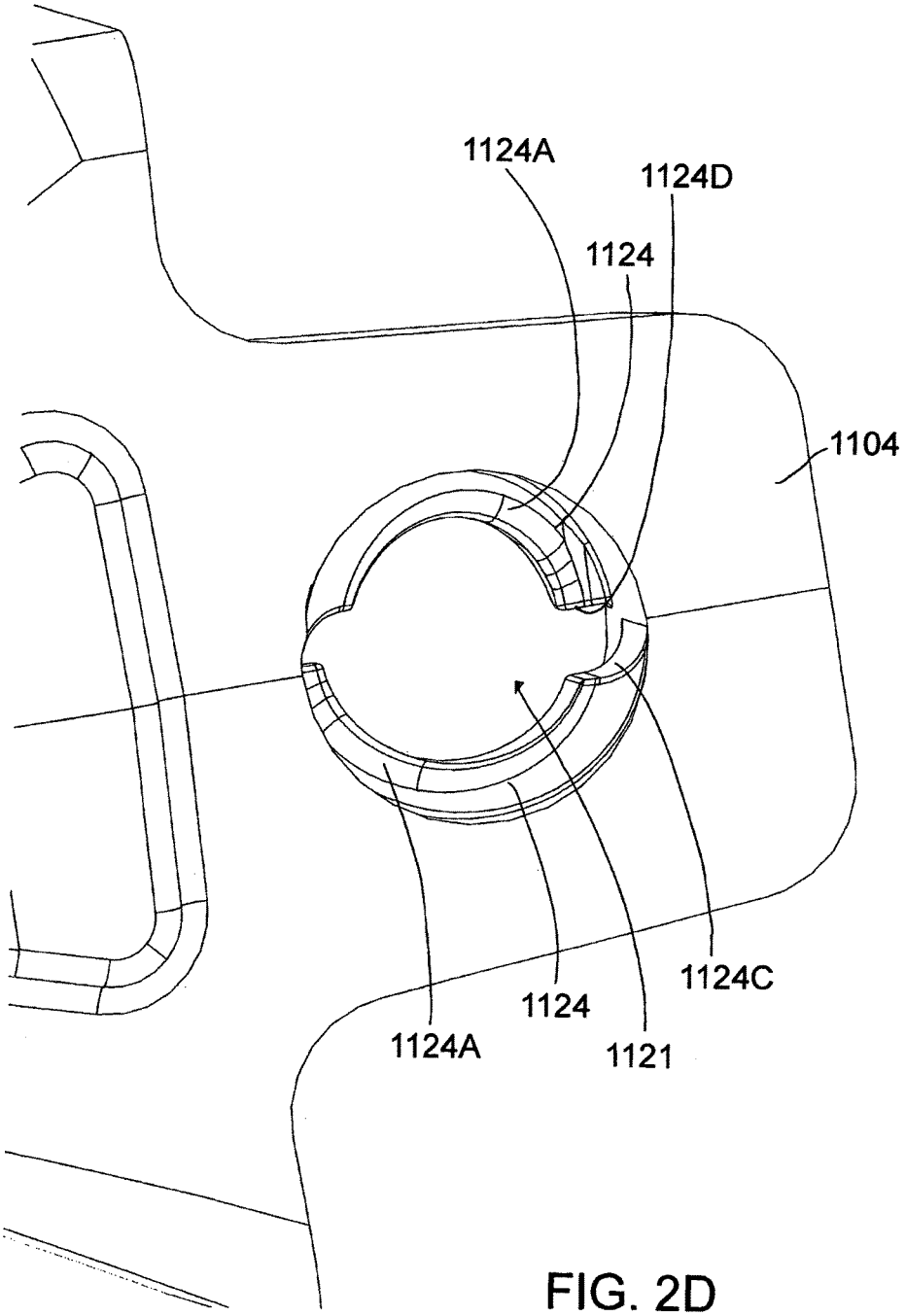
FIG. 2D shows a partial external view of one of the ears of the tooth shown in FIG. 2A.
Figure 2E:
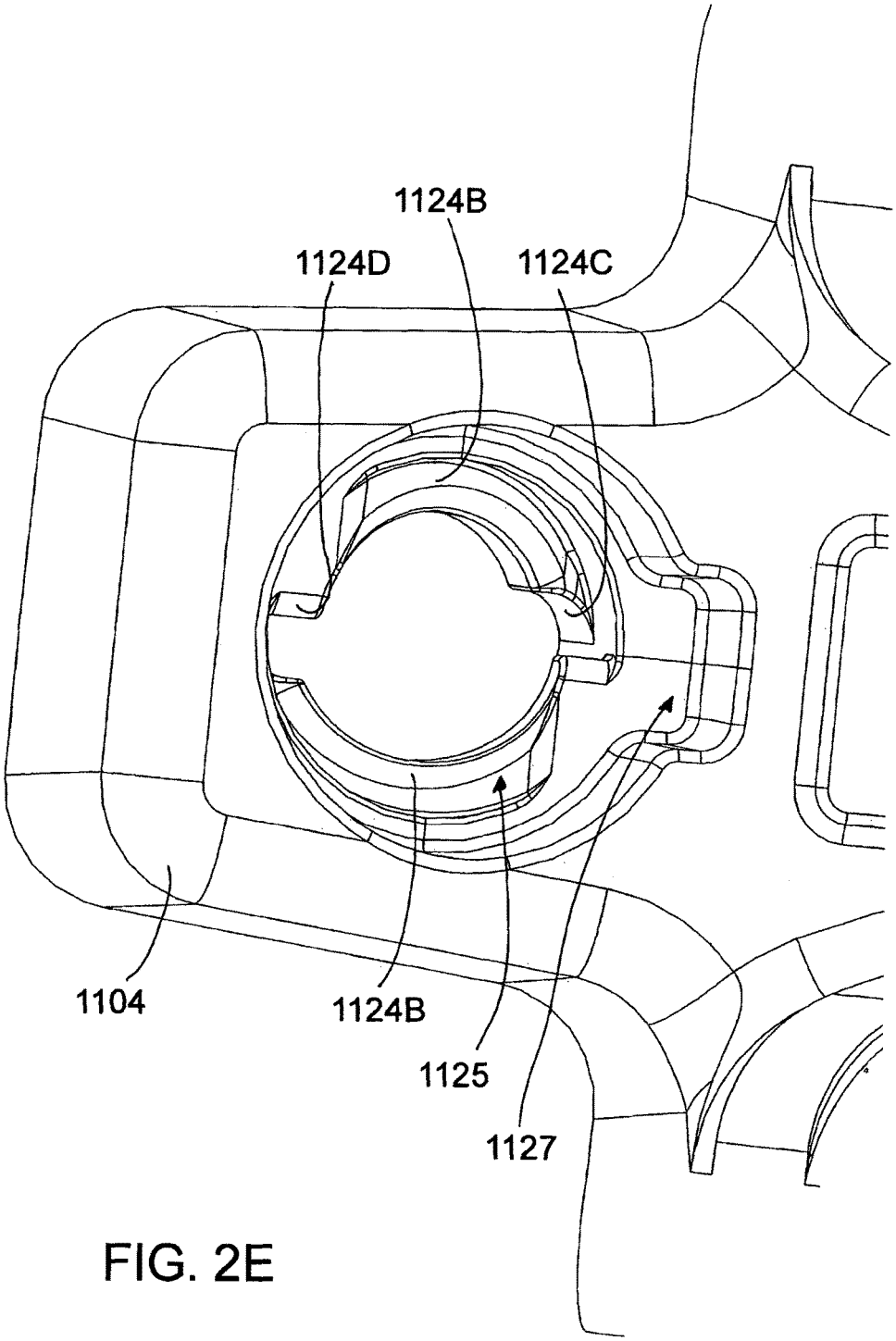
FIG. 2E shows a partial internal view of one of the ears of the tooth shown in FIG. 2A.

FIG. 2A shows a reverse perspective view of wear member in the form of tooth 1100. FIG. 2B shows a rear perspective view of the tooth 1100 and FIG. 2C shows a sectional perspective view of the tooth 1100.

Tooth 1100 has a forwardly projecting working end 1101 and a socket cavity 1110 formed from converging upper and lower rear bearing surfaces 1111 and 1112 respectively. Each of upper and lower bearing surfaces 1111 and 1112 terminate at substantially parallel upper and lower forward bearing surfaces 1113 and 1114 respectively. A front bearing face 1115 is disposed between upper forward bearing surface 1113 and lower forward bearing surface 1114.

Bearing surfaces 1111, 1112, 1113, and 1114 and front bearing face 1115 of tooth socket 1110 are configured to be complimentary with bearing surfaces 1231, 1232, 1233 and 1234 and front bearing face 1235 respectively of spigot portion 1230 of adaptor 1200. Socket cavity 1110 is adapted to receive spigot portion 1230 of adaptor 1200.

Tooth 1100 further includes mounting ears 1103 and 1104 extending rearwardly of tooth body 1102 from opposed sides thereof. In use, mounting ears 1103 and 1104 are adapted to be located within mounting recesses 1203 and 1204 respectively of adaptor 1200.

Additionally, a toe aperture 1130 extends through mounting ear 1103 and a locking aperture 1120 extends through opposed mounting ear 1104 as shown. In use, toe aperture 1130 and locking aperture 1120 are adapted to at least partially align with retaining passage 1237 of adaptor 1200.

Toe aperture 1130 is generally circular in cross section and extends through mounting ear 1103 as shown.

Locking aperture 1120 extends through mounting ear 1104. Optionally, locking aperture 1120 may extend through any wall of the tooth 1100

The locking aperture 1120 is formed from a receiving passage 1121 and a retaining recess 1125.

Receiving passage 1121 extends inwardly from an outer face of tooth 1100 and terminates at retaining recess 1125 located on an inner face of mounting ear 1104.

Receiving passage 1121 has a generally circular main portion 1122 and a pair of ramps 1124 extending about an inner face of receiving passage 1121 such that each ramp 1124 starts from diametrically opposite sides of receiving passage 1121 adjacent an outer end thereof and traverse a half circumferential path about inner face of receiving passage 1121 to terminate adjacent retaining recess 1125.

Each ramp 1124 defines an outwardly facing insertion face 1124A and an inwardly facing withdrawal face 1124B.

Retaining recess 1125 has a generally circular main portion 1126 and a blind slot 1127 extending outwardly from circular main portion 1126. Circular main portion 1126 of retaining recess 1125 is concentric with circular main portion 1122 of receiving passage 1121 with circular main portion 1126 having a relatively larger diameter thereby forming a locking face 1128 at an inner end of retaining recess 1125.

Figure 3:
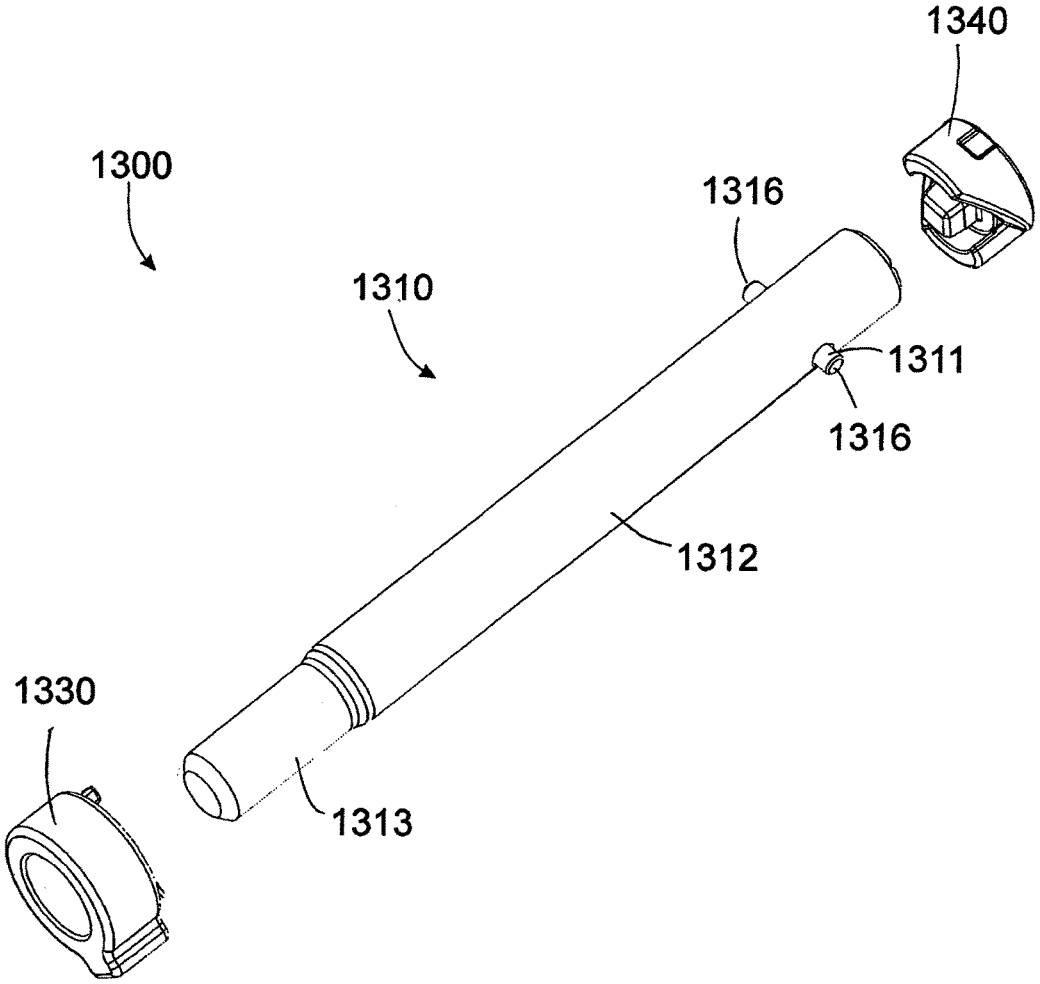
FIG. 3 shows a perspective exploded view of a lock assembly shown in FIG. 1A.

FIG. 3 shows an exploded perspective view of lock assembly 1300.

Lock assembly 1300 comprises a locking pin 1310, a retaining member 1330 and a keeper 1340.

Figure 4A:
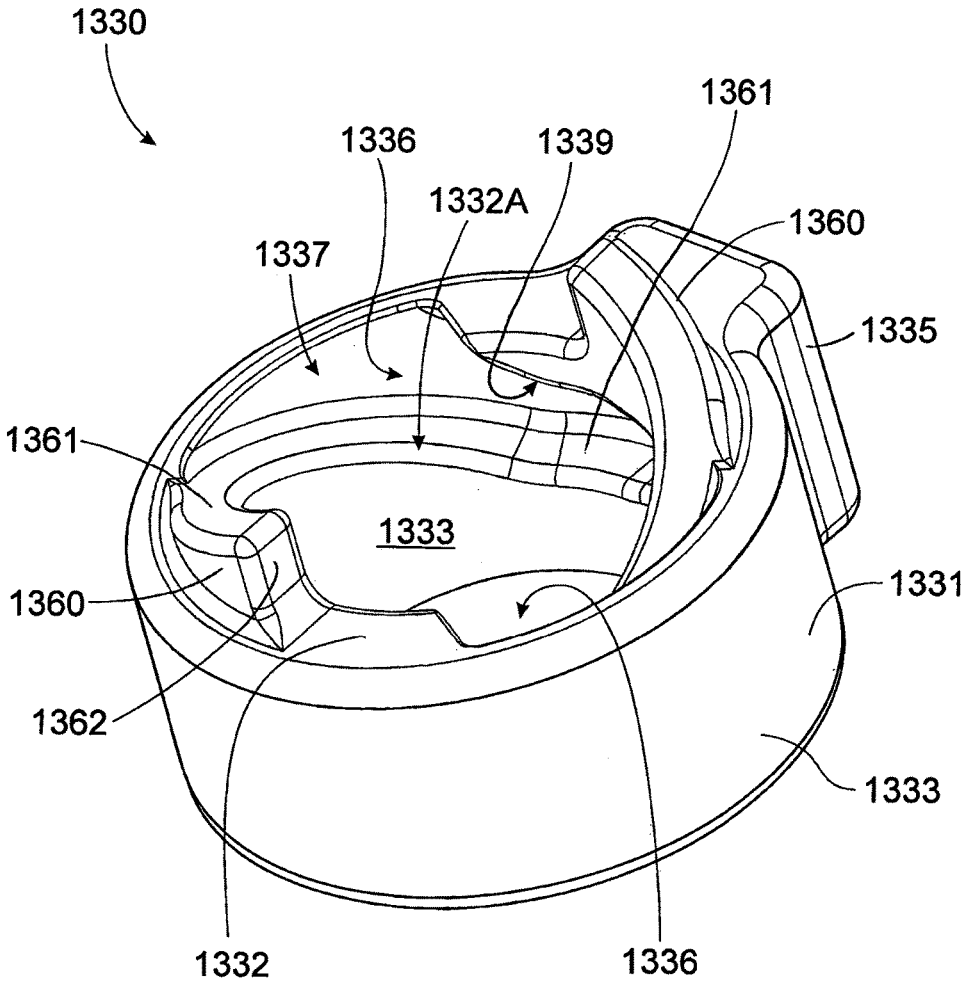
FIG. 4A shows a topside perspective view of a retaining member forming part of the lock assembly shown in FIG. 3.
Figure 4B:
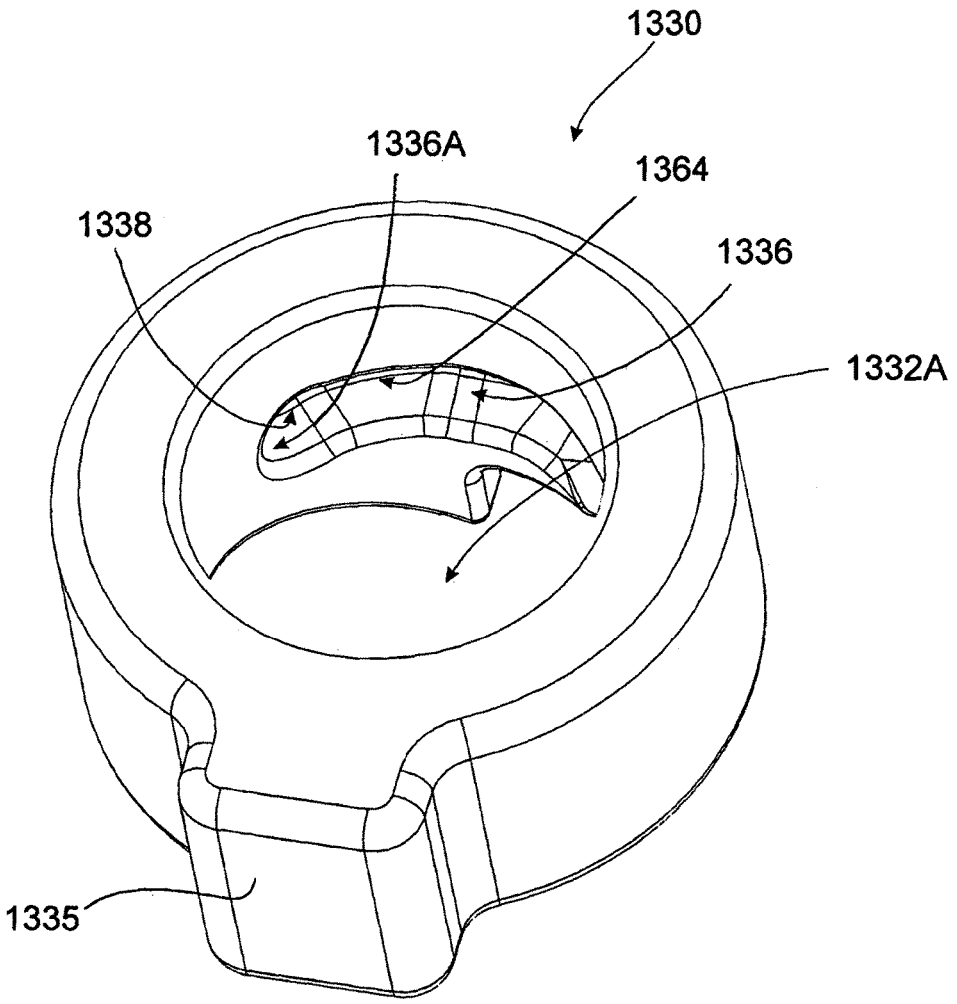
FIG. 4B shows an underside perspective view of the retaining member shown in FIG. 4A.
Figure 4C:
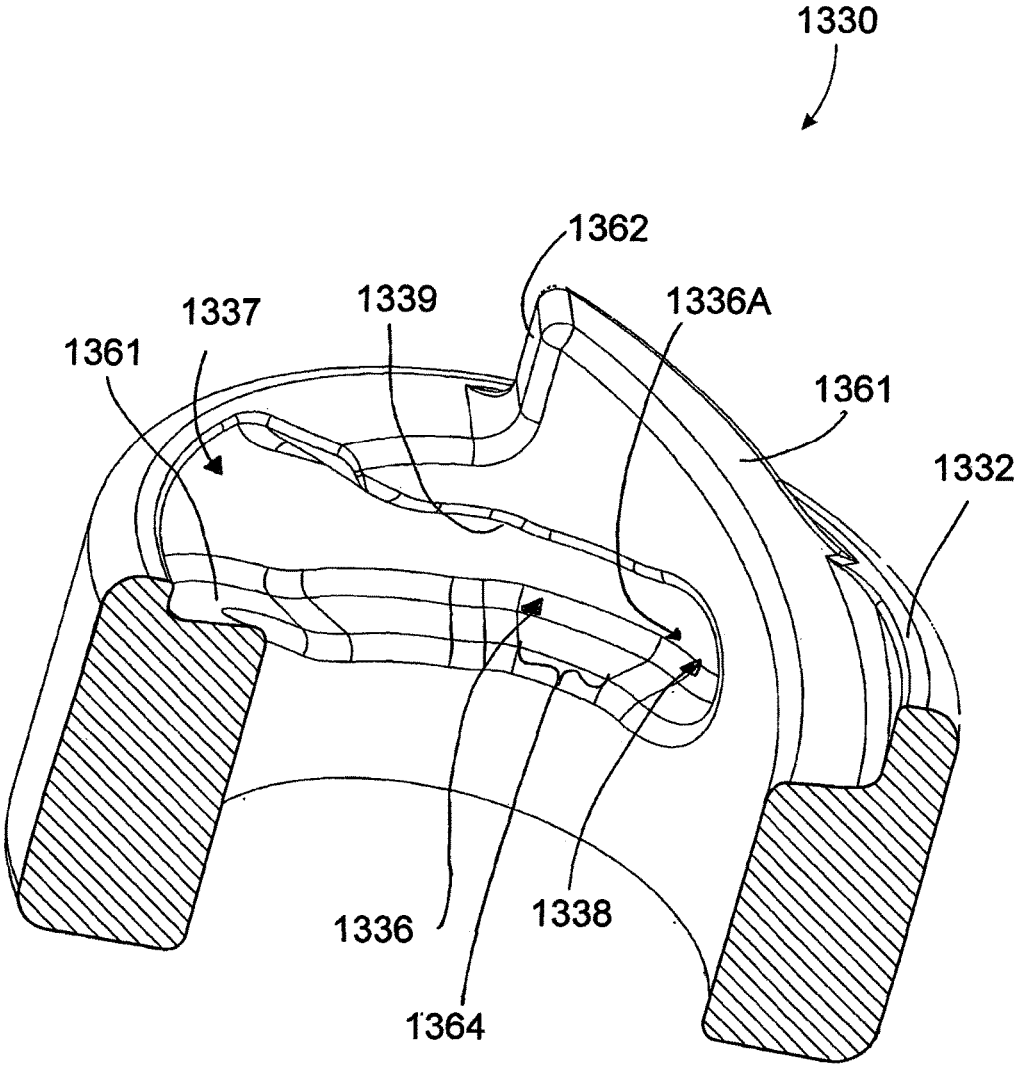
FIG. 4C shows a sectional view of the retaining member shown in FIG. 4A.
Figure 4D:
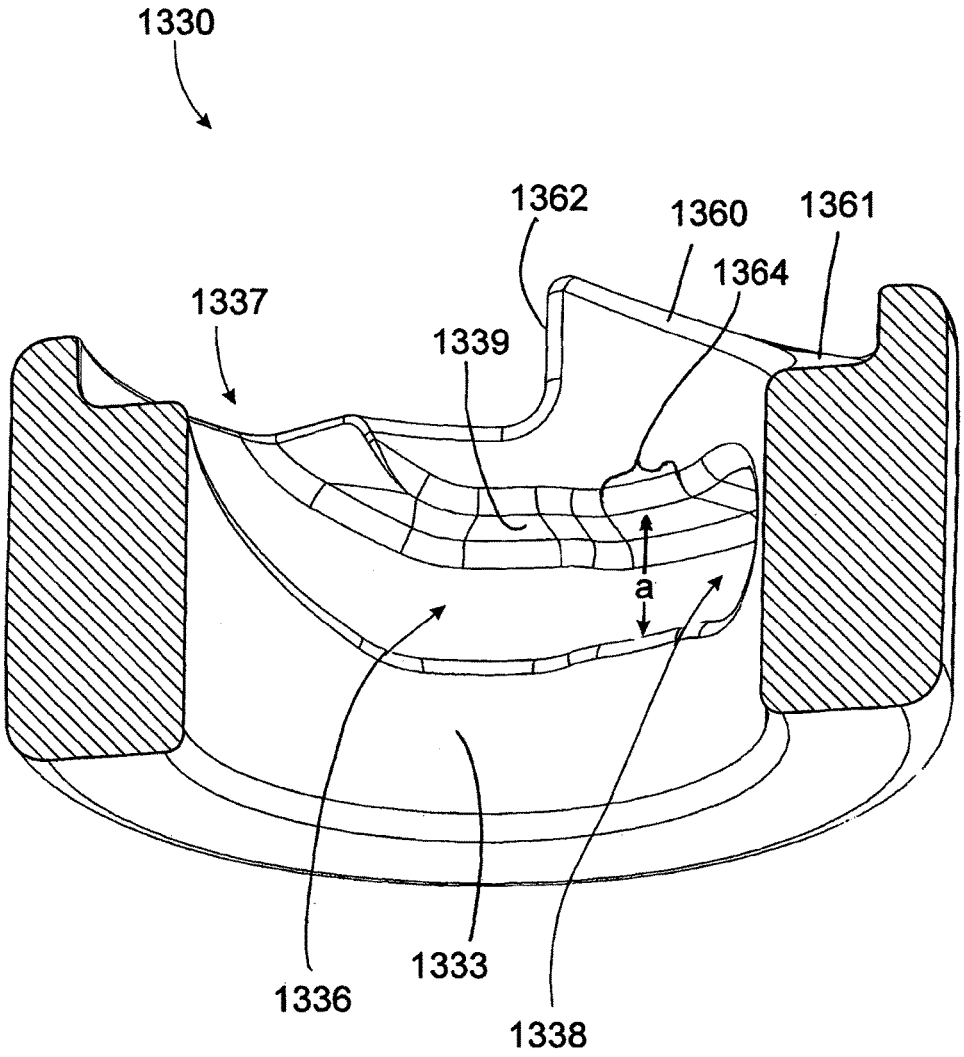
FIGS. 4D to 4F show sectional views of the retaining member shown in FIG. 4A, viewed form a different angles to FIG. 4C.

FIG. 4A shows a topside perspective view of retaining member 1330 and FIG. 4B shows an underside perspective view of retaining member 1330. FIGS. 4C to 4F show different cross sectional views of retaining member 1330.

Retaining member 1330 has a body 1331 having an aperture 1332A extending through a top surface 1332 thereof. A detent 1335 extends outwardly from body 1331 as shown.

Retaining member 1330 further includes a pair of slots 1336 extending circumferentially about an inner face of annular wall 1333 as shown.

The slots 1336 have entrance openings 1337 located in the top surface 1332. The entrance openings 1337 are diametrically opposed about top surface 1332. Slots 1336 are adapted to receive the dowel ends 1316 of locking pin 1310.

Each slot 1336 has a narrowed section 1364. The slot 1336 follows a helical path with decreasing pitch from the entrance opening 1337 to the narrowed section 1364.

Each slot 1336 includes an angled guide surface 1339 on an underside of top surface 1332 with each angled guide surface 1339 extending from a respective entrance opening 1337 to a seat 1338 at a blind end 1336A of slot 1336.

Figure 4E:
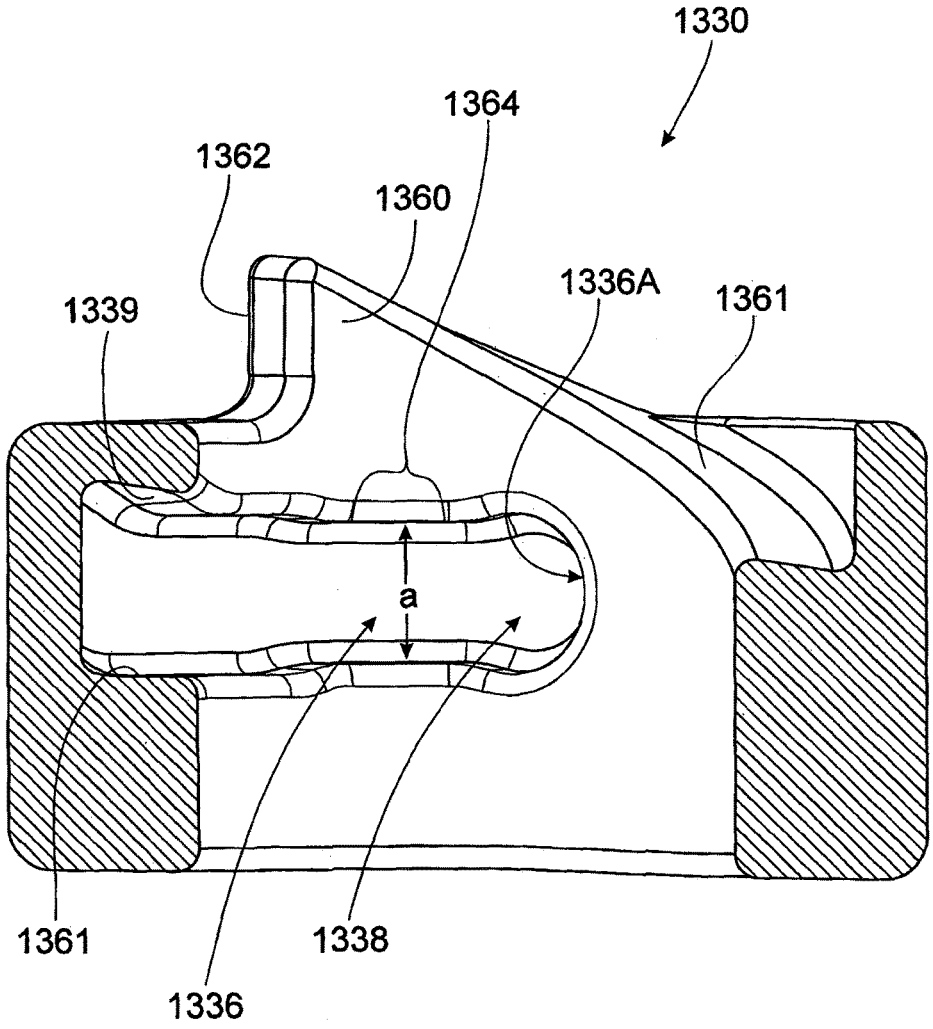
Figure 4F:
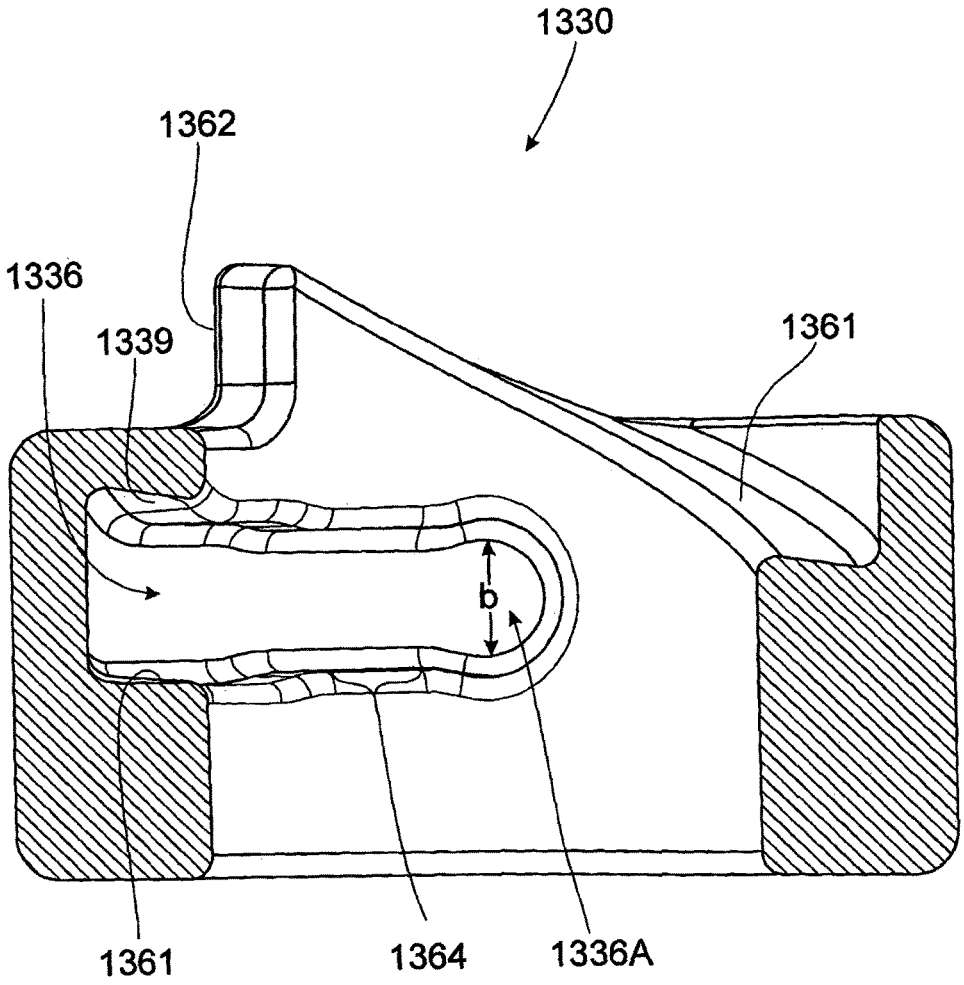

The seat 1338 is generally cylindrical having a width "b" shown in FIG. 4F. As shown each seat 1338 is axially offset from an entrance opening 1337.

Retaining member 1330 further includes a pair of ramps 1360 each having a guide surface 1361 that extends from within slot 1336 and terminates outwardly of an exterior surface in the form of top surface 1332 as shown.

Guide surface 1361 is adapted to guide a respective dowel 1311 of locking pin 1310 when locking pin 1310 is being removed from excavator wear assembly as will be discussed in greater detail below.

The slot 1336 is defined between the guide surfaces 1339 and 1361. Part of the guide surface 1339 forms a roof of the slot 1336. Part of the guide surface 1361 forms a floor of the slot 1336. The width "a" of the slot 1336 at the narrowed section 1364 is less than the cross sectional dimension "c" of the dowel 1311. The width "a" of the slot 1336 along the narrowed section 1364 is measured between the roof of the slot 1336 and the floor of the slot 1336 as shown in FIG. 4E.

The width "b" of the seat 1338 is greater than the cross sectional dimension "c" of the dowel 1311.

Each ramp 1360 has an abutment face 1362 extending outwardly from top surface 1332 and terminating at guide surface 1361.

Body 1331 is adapted to be received in circular main portion 1126 of retaining recess 1125 and detent 1335 is adapted to be received in blind slot 1127 of retaining recess 1125.

Figure 5A:
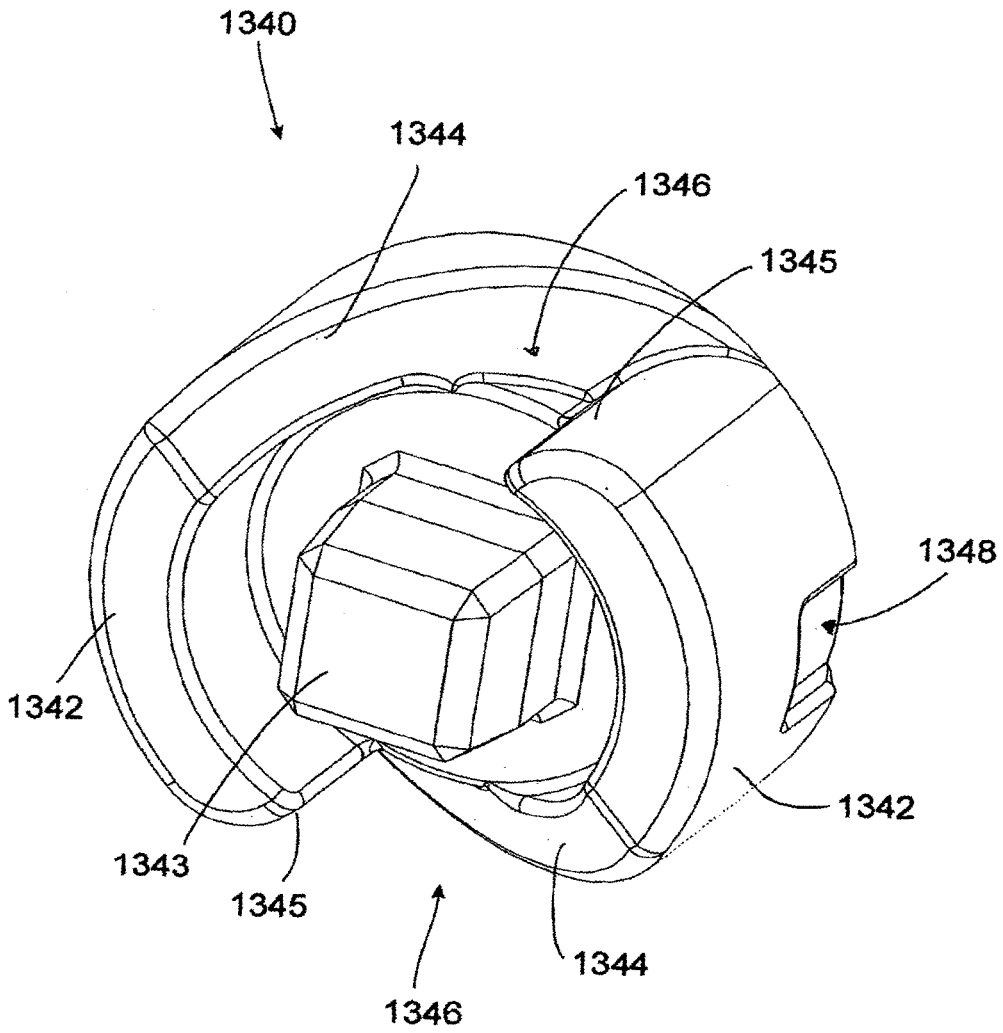
FIG. 5A to 5C show a perspective views of a keeper forming part of the lock assembly shown in FIG. 3.
Figure 5B:
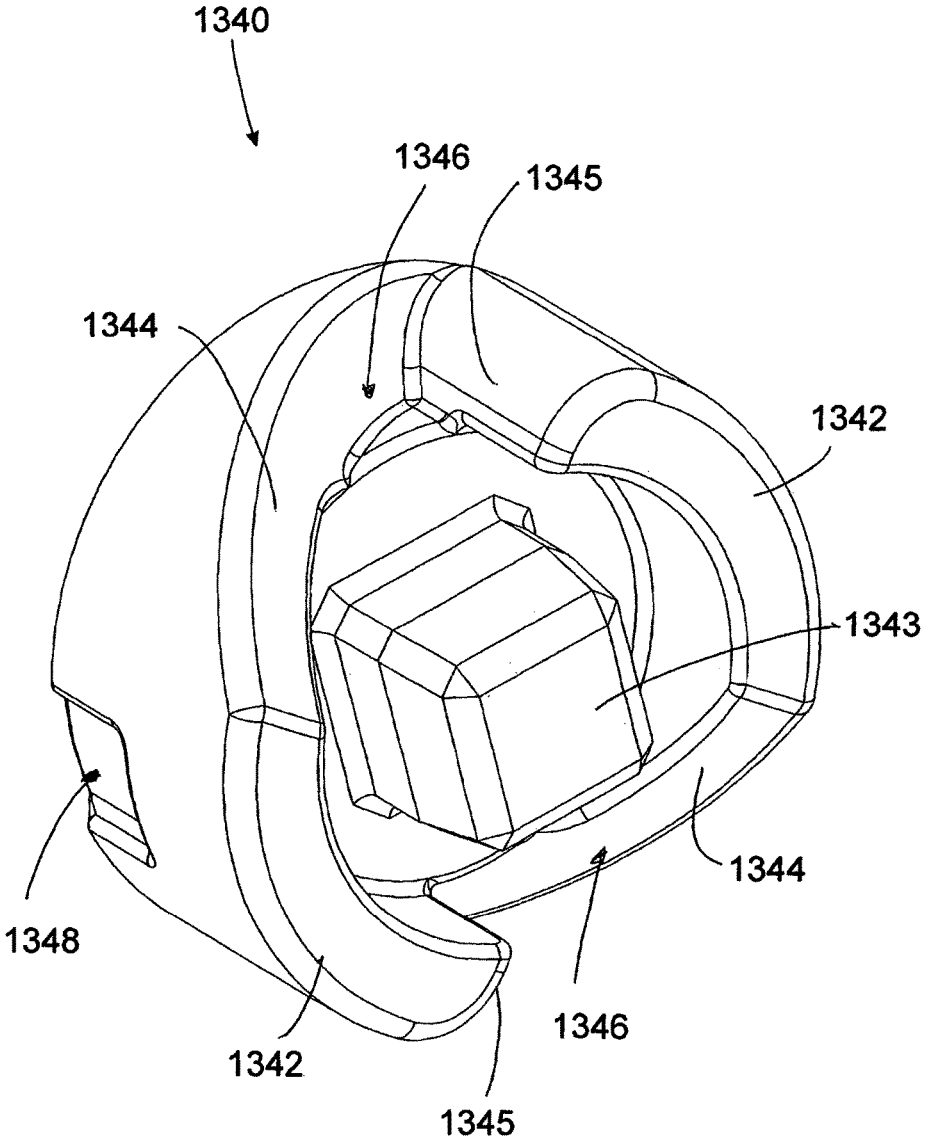
Figure 5C:
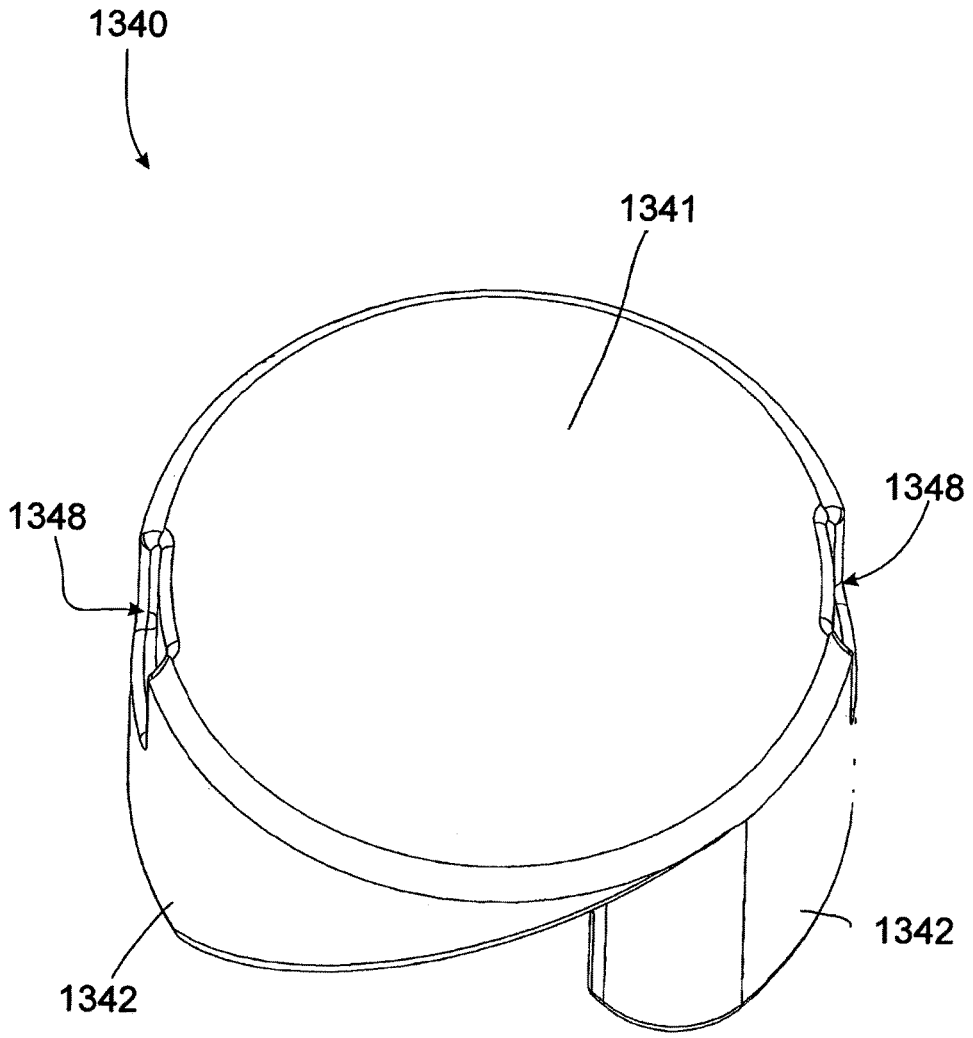

FIGS. 5A and 5B show an underside perspective view of keeper 1340 forming part of locking assembly 1300. FIG. 5C shows a topside perspective view of keeper 1340.

Keeper 1340 has a generally circular top portion 1341 and a pair, of ramps 1342 extending from diametrically opposed sides of top portion 1341. Keeper 1340 further includes a plug 1343 extending from a central region of an underside of top portion 1341. Plug 1343 is adapted to be securely located within recess 1314 of locking pin 1310. The plug 1343 is generally square in cross section.

Each ramp 1342 has a tapered face 1344 and a locating face 1345 creating an arcuate cutout 1346 between adjacent ramps 1342 as shown. Each tapered edge 1344 and each locating edge 1345 are adapted to abut complementary faces located within a locking aperture of a tooth as discussed in greater detail below.

The keeper 1340 has grip recesses 1348 in the top portion 1341 of the keeper 1340. The grip recesses 1348 are located diametrically opposite each other.

Figure 6A:
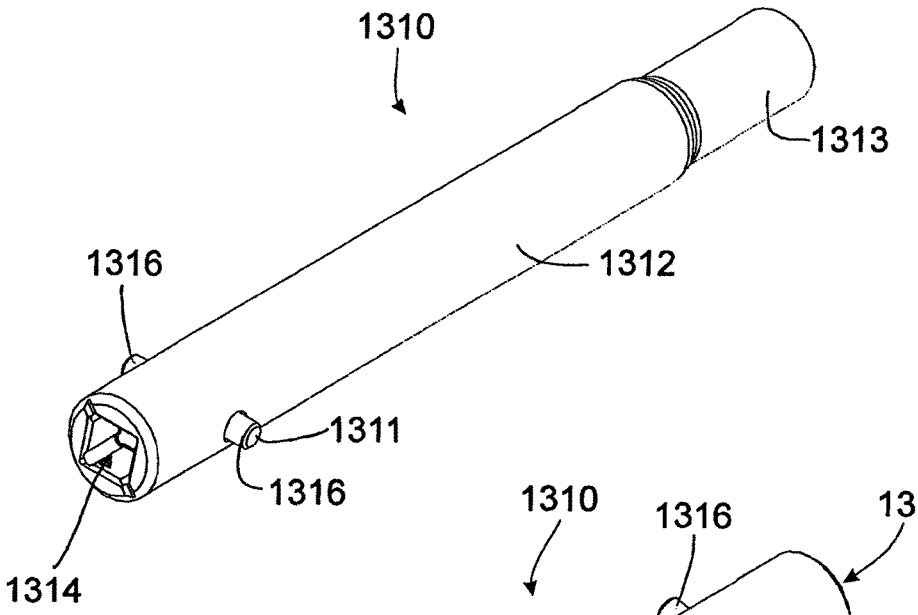
FIGS. 6A and 6B show perspective views of the locking pin shown in FIG. 3.
Figure 6B:
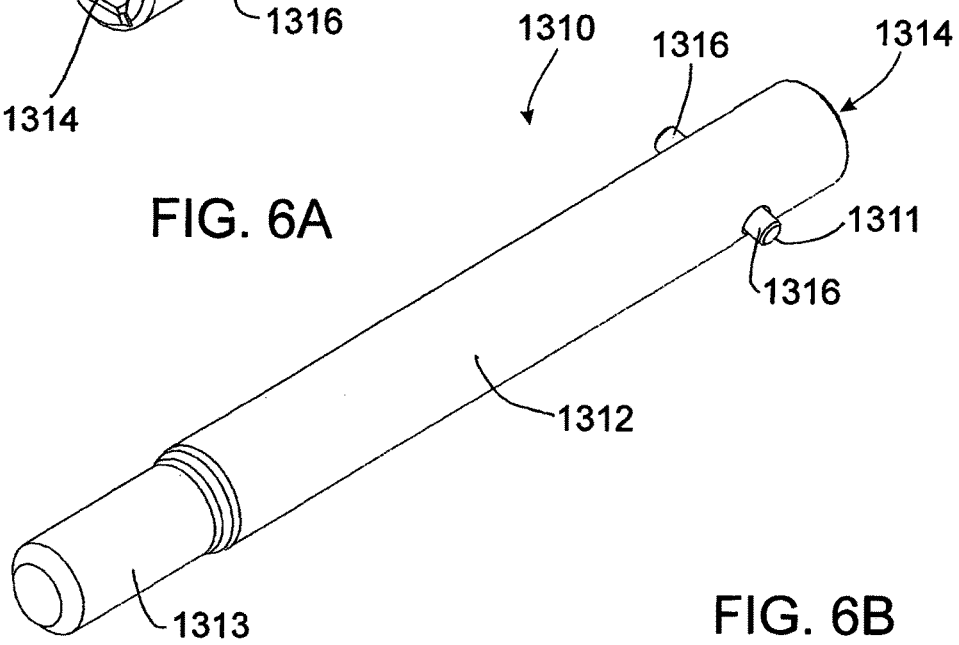

FIGS. 6A and 6B show perspective views of locking pin 1310. Locking pin 1310 has a main portion 1312 and the dowel 1311. The dowel 1311 has opposite dowel ends 1316 extending outwardly from main portion 1312 at an end thereof from diametrically opposed sides thereof. The dowel 1311 has a uniform cross sectional dimension "c".

Locking pin 1310 also has a toe portion 1313 extending from an end of main portion 1312 distal dowel 1311. Locking pin 1310 further comprises a square recess 1314 located in an end thereof adjacent dowels 1311.

Main portion 1310 is tapered such that the cross sectional dimensions are smaller proximal toe portion 1313 than square recess 1314.

This tapering allows for easy removal of locking pin 1310 from retaining passage 1237.

Toe portion 1313 is adapted to be located in toe aperture 1130 of tooth 1100 as will be discussed in greater detail below.

When retaining member 1330 and keeper 1340 are fitted to locking pin 1310, a channel 1315 is formed between keeper 1340 and retaining member 1330.

Retaining member 1330 is located within retaining recess 1125 of locking aperture 1120 of tooth 1100 as shown in FIG. 7A-FIG. 7D. As shown, in this position detent 1335 is located within blind slot 1127 thereby non-rotatably locating retaining member 1330 within retaining recess 1125.

Figure 7A:
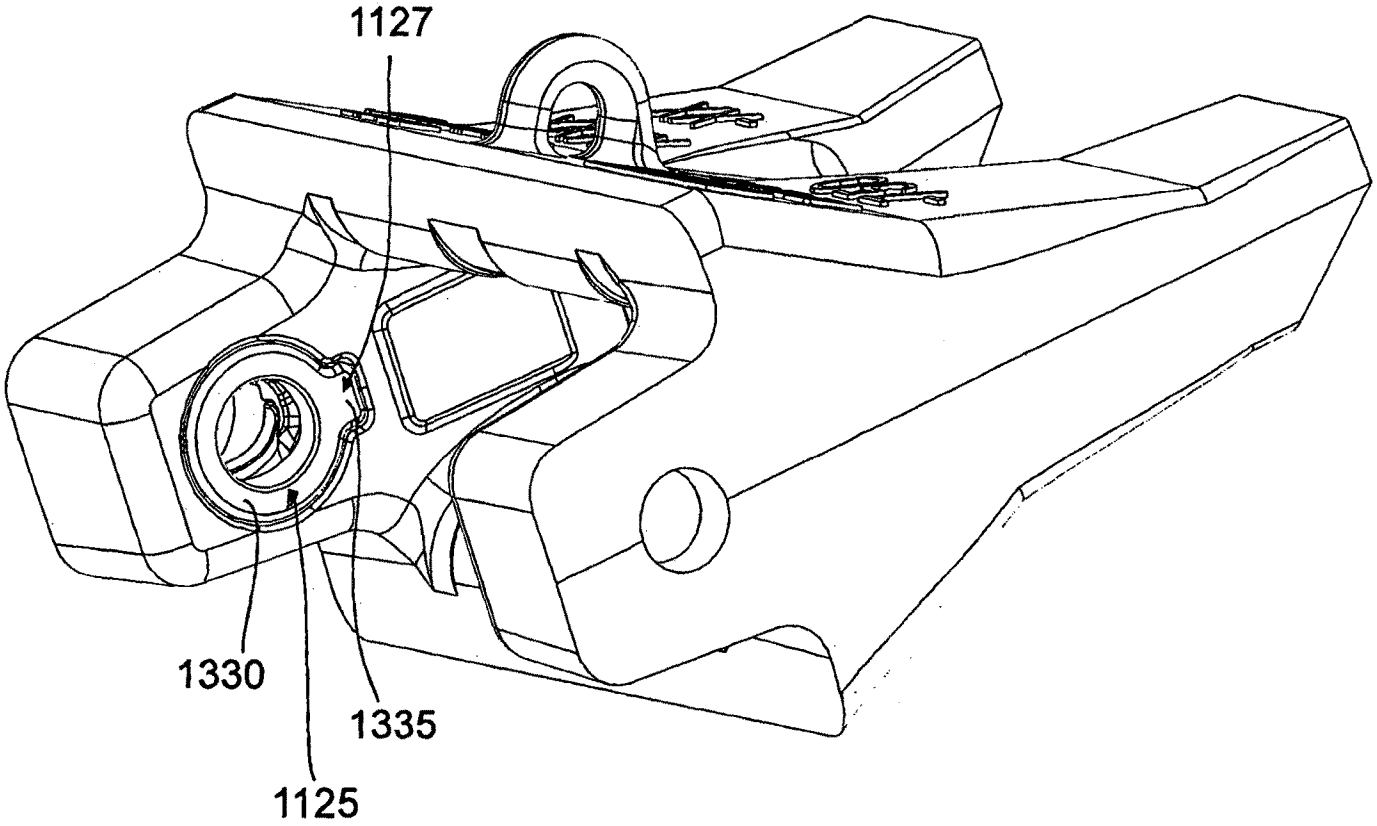
FIG. 7A shows a rear perspective view of the retaining member of FIG. 4A to 4F located within a tooth.
Figure 7B:
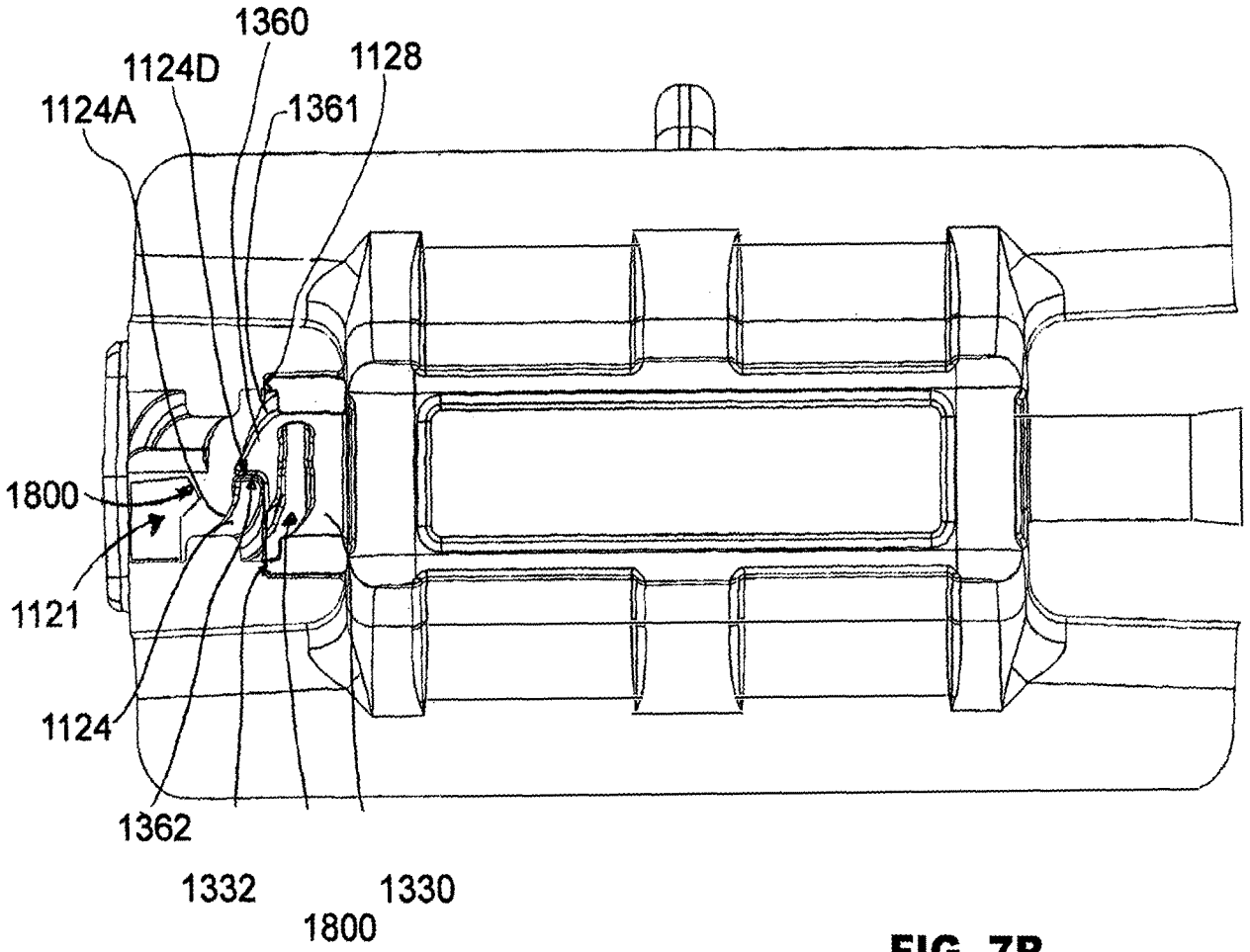
FIG. 7B shows a sectional rear perspective view of the view shown in FIG. 7A.
Figure 7C:
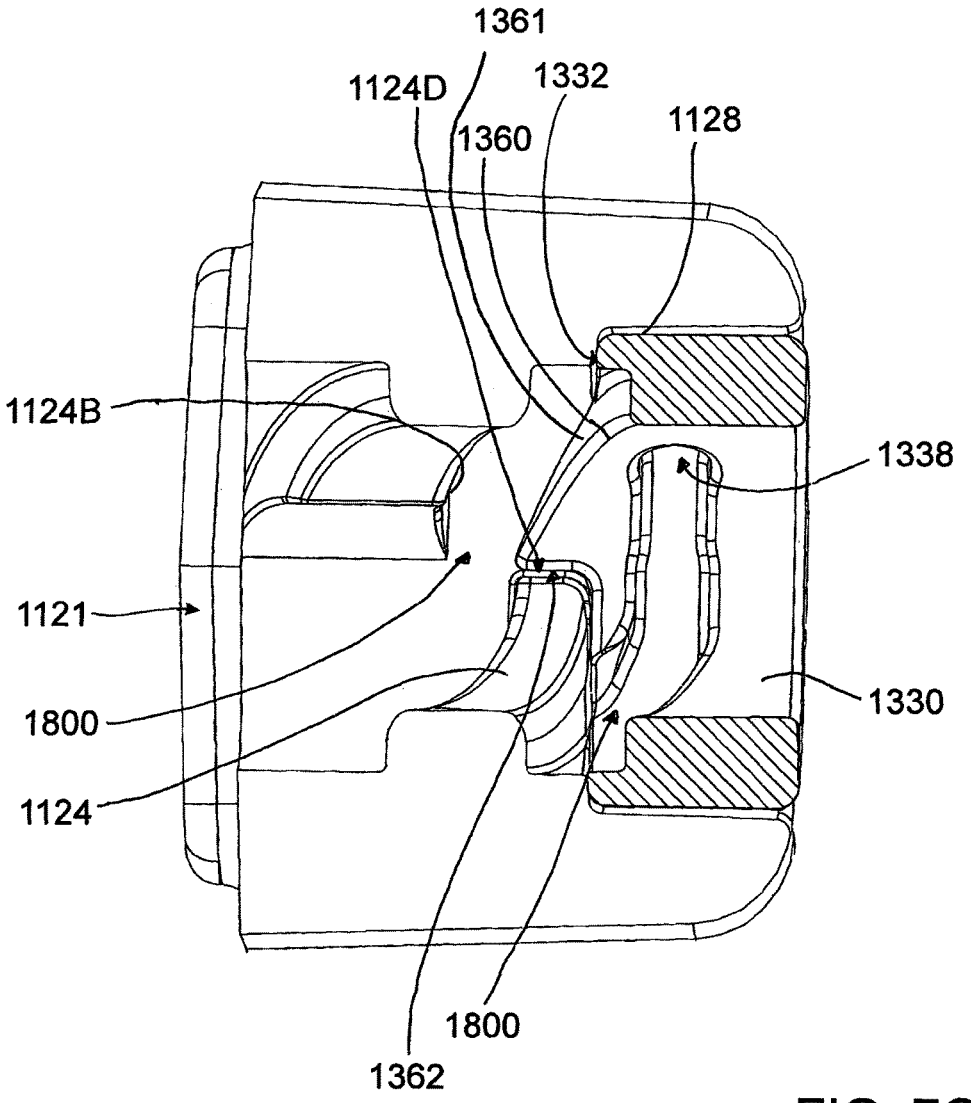
FIG. 7C shows a part sectional view of the view shown in FIG. 7B.
Figure 7D:
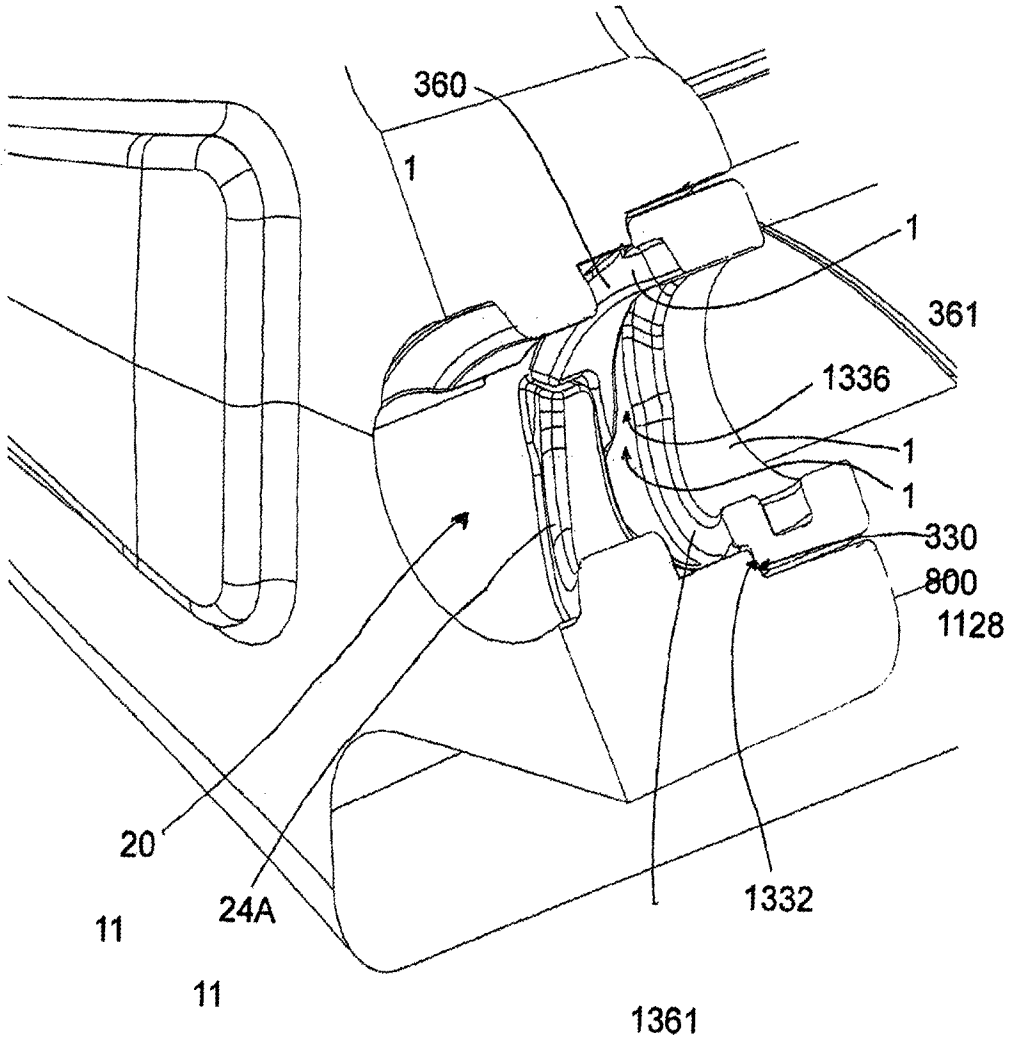
FIG. 7D shows a perspective sectional view of the view shown in FIG. 7B.

Furthermore, top surface 1332 of retaining member 1330 abuts locking face 1128 as shown in FIGS. 7A and 7B.

Abutment face 1362 of each ramp 1360 of retaining member 1330 engages a face of tail portion 1124D of a respective ramp 1124 in receiving passage 1121, thereby aligning each guide surface 1361 of retaining member 1330 with a respective outwardly facing insertion face 1124A of each ramp 1124 as shown.

In this arrangement, twin helical slots 1800 with decreasing pitch are formed to enable passage within a helical slot 1800 of a respective dowel end 1316 of locking pin 1310 to a respective seat 1338 of retaining member 1330 as will be discussed in greater detail below.

Each helical slot 1800 is formed by the passage between guide surface 1361 and withdrawal face 11248 of a respective ramp 1124. The helical slot 1800 then extends to slot 1336 of retaining member 1330, traverses between the narrowed section 1364 of the slot 1336 before terminating at seat 1338 of retaining member 1330.

In an optional embodiment, retaining member 1330 may be permanently secured within retaining recess of locking aperture 1120 of tooth 1100 by means of a chemical fastener or the like. Alternatively, retaining member 1330 alone may be integrally formed with tooth 1100. In such an embodiment, a skilled addressee will appreciate that reference to a retaining member in this specification would be a reference to a retaining portion of the wear member in the form of tooth 1100.

To retain the tooth 1100 on the adaptor 1200, the tooth 1100 is slidably mounted onto adaptor 1200 such that spigot portion 1230 is located within socket cavity 1110 of tooth 1100 as previously discussed. The locking pin 1310 of lock assembly 1300 is then located adjacent locking aperture 1120.

Figure 8:
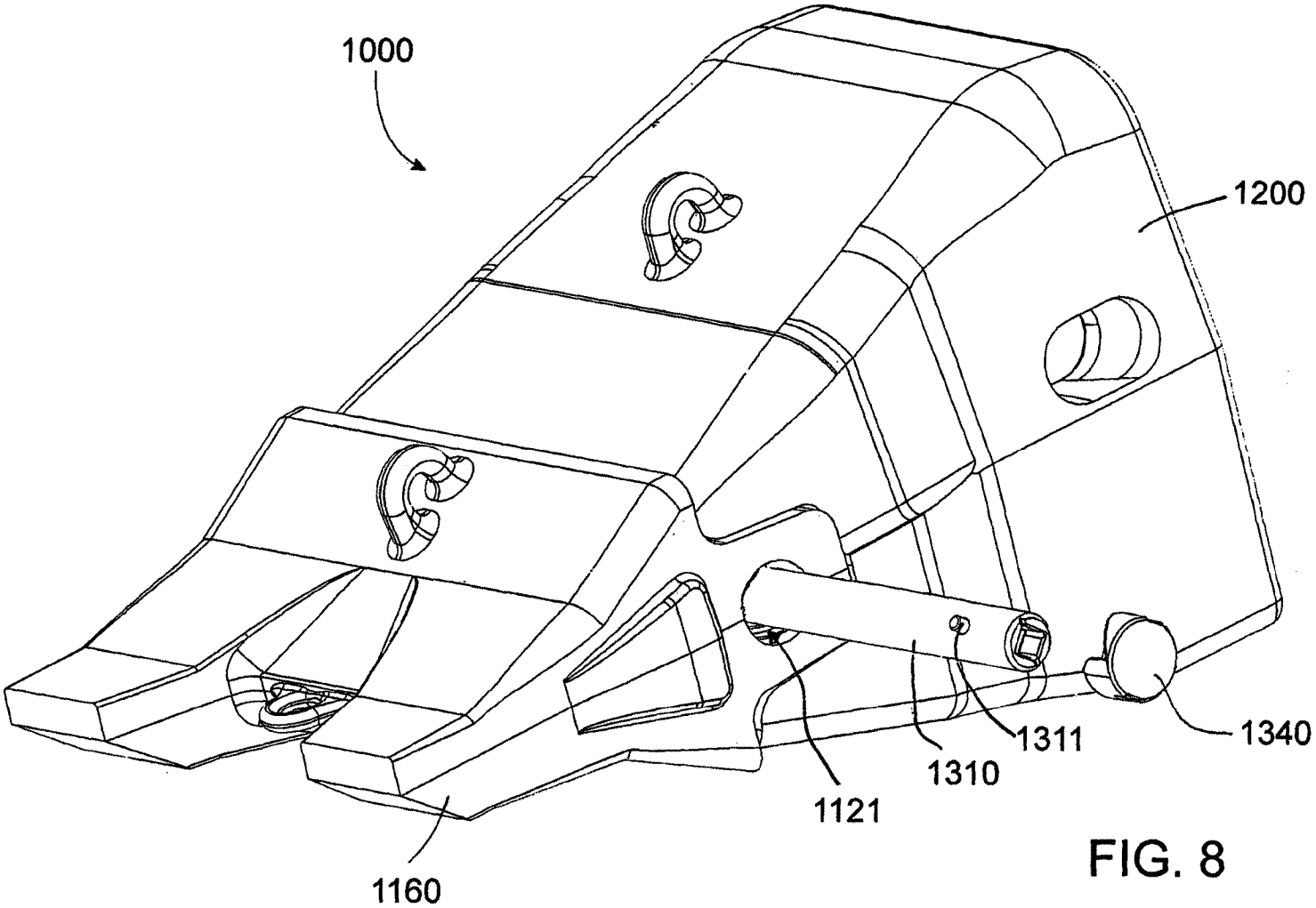
FIG. 8 shows locking pin forming part of the lock assembly located through partially inserted through aligned aperture in the tooth and passage in the adaptor, the locking pin positioned in the insertion position.

In order to move the lock assembly 1300 to a locked position, thereby releasably securing tooth 1100 on adaptor 1200, toe portion 1313 of locking pin 1310 is first located through locking aperture 1120 of tooth 1100 as shown in FIG. 8. Toe portion 1313 travels through receiving passage 1121 of locking aperture 1120, aligned aperture 1332A of retaining member and into retaining passage 1237 of spigot portion 1230 of adaptor 1200.

In this position, or prior to insertion, locking pin 1310 is rotated axially clockwise about a longitudinal axis thereof such that dowel 1311 is generally coplanar with a plane formed by aligned seats 1338 of retaining member 1330.

Dowel 1311 traverse within helical slots 1800 commencing travel from the portion of a respective helical slot 1800 formed by opposing faces of the guide surface 1361 of ramp 1360 and the withdrawal face 1124B of a respective ramp 1124.

The travel of each dowel 1311 within a respective helical slot 1800 causes locking pin 1310 to locate within the retaining member 1330 and also urges rotation of the locking pin 1310 about a longitudinal axis thereof.

Figure 9A:
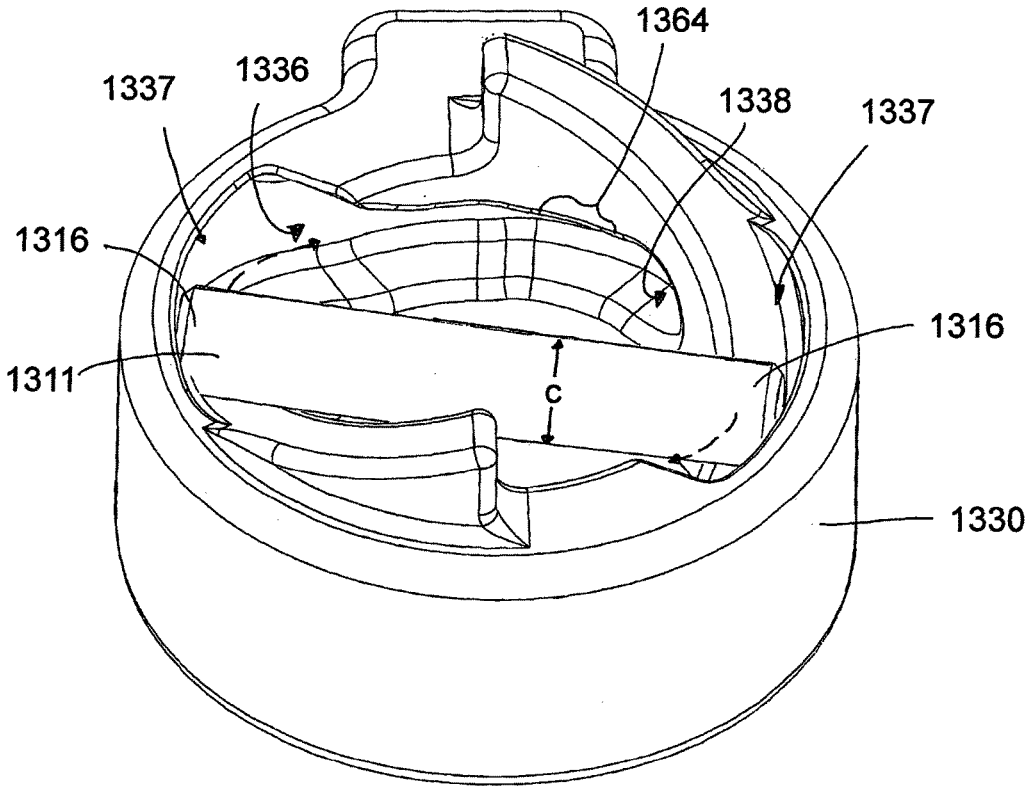
FIG. 9A shows a sectional top view of the dowel of the locking pin in a release position as the dowel traverses the locking member.
Figure 9B:
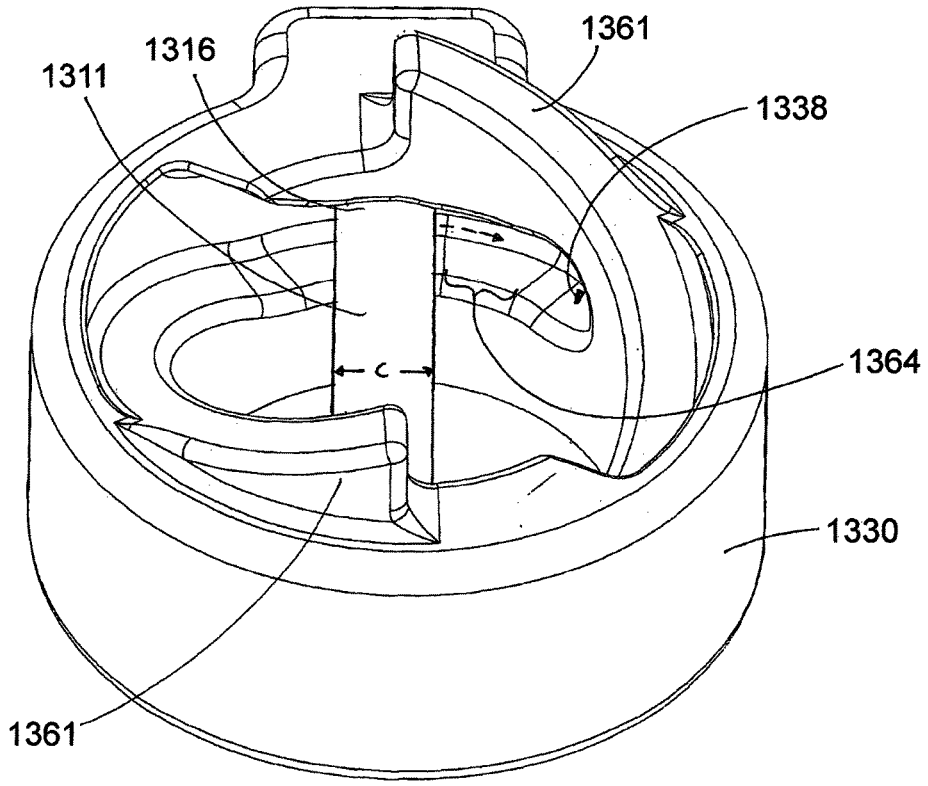
FIG. 9B shows a sectional top view of the dowel and locking member of FIG. 9A, with the dowel bearing against a narrowed section of a slot in the locking member.
Figure 9C:
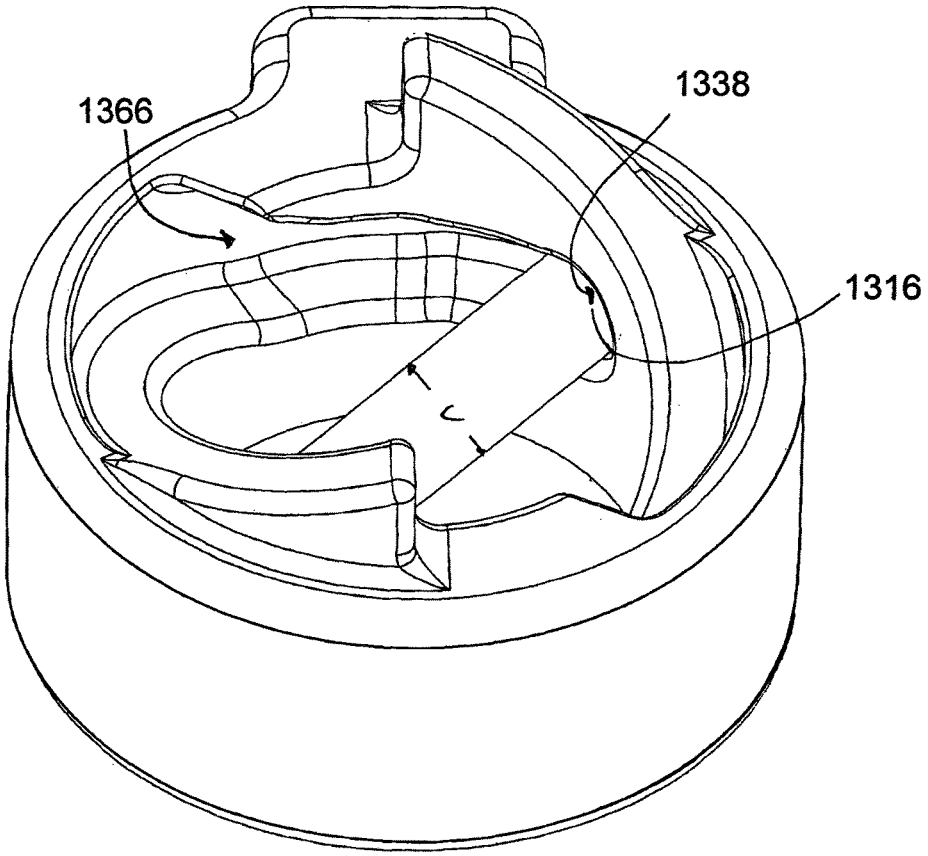
FIG. 9C shows a sectional top view of the dowel and locking member of FIG. 9A, with the dowel located in a seat of the slot of the locking member.

FIGS. 9A to 9C show the sequence of translation of the dowel 1311 along the slots 1336 of retaining member 1330 from the entrance openings 1337 of the slots 1336 to being captured in the seats 1338 at the ends of the slots 1336. In order to translate the dowel 1311, the main portion 1312 (not shown in FIGS. 9A to 9C) of the locking pin 1310 is rotated axially about a longitudinal axis.

FIG. 9A shows the dowel 1311 with the dowel ends 1316 received at the entrance openings 1337 of retaining member 1330. The dowel 1311 is in a released position wherein the dowel is free to travel along the slots 1336 of retaining member 1330.

Translation of the dowel 1311 continues until the dowel ends 1316 bear against the narrowed section 1364 of slot 1336, as shown in FIG. 9B.

The narrowed section 1364 is slightly narrower than the diameter of the dowel ends 1316, but wide enough to allow the dowel ends 1316 to be forced through the narrowed section 1364. That is to say that the dowel ends 1316 have to pass through the narrowed section 1364 under interference.

In order to completely translate lock assembly 1300 to the locked position, locking pin 1310 is rotated axially clockwise about a longitudinal axis thereof in order to force, the dowel ends 1316 through the narrowed section 1364 and into the respective seats 1338 as shown in FIG. 9C.

The dowel ends 1316 resiliently deform the narrowed section 1364 in order to pass therethrough as the locking pin 1310 is axially rotated in order that the dowel ends 1316 may be located in respective seats 1338. That is, the material forming the retaining member 1330 resiliently deforms in the region of the narrowed section 1364 to allow passage of the dowel ends 1316 as described.

Optionally, the dowel ends 1316 also resiliently deform in order that the dowel ends 1316 may pass through the narrowed section 1364.

In the locked position of the lock assembly 1300 the dowel 1311 is in the position captured in the seats 1388 shown in FIG. 9C.

Figure 10A:
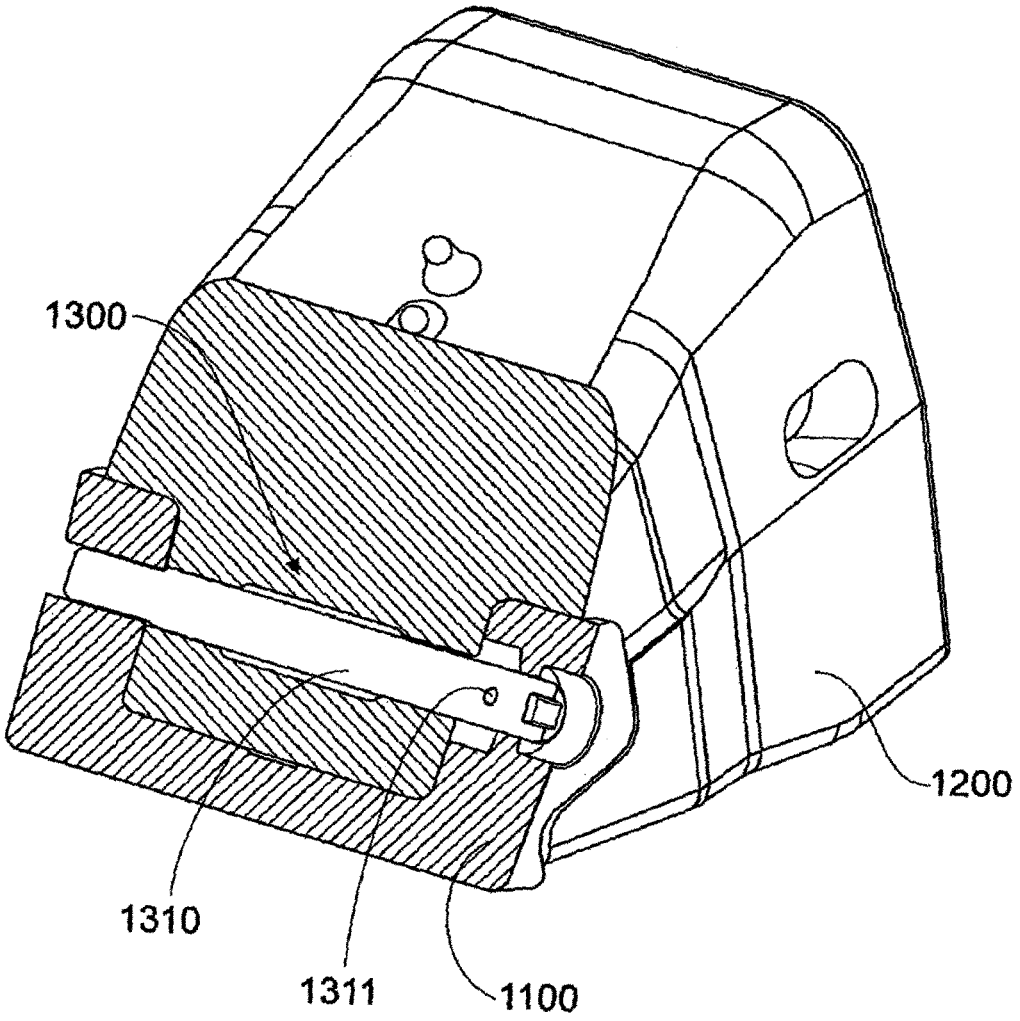
FIG. 10A shows a sectional view of the lock assembly in the locked position.

FIG. 10A shows a cross sectional view of the lock assembly 1300 in the locked position with the dowel 1311 in the position shown in FIG. 9C in order to captively retain locking pin 1310 within partially aligned locking aperture 1120, retaining passage 1237 and toe aperture 1130 as shown. As such, wear member in the form of tooth 1100 is releasably secured to adaptor 1200 by lock assembly 1300.

Figure 10B:
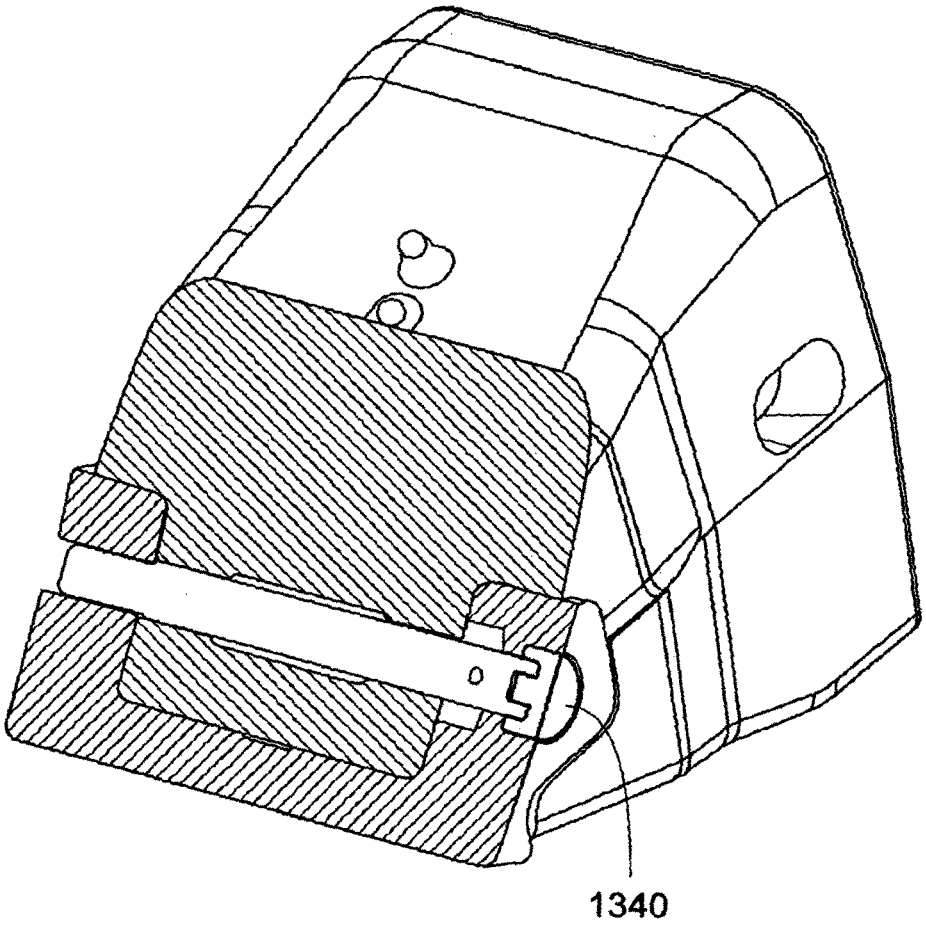
FIG. 10B shows a sectional view of the lock assembly in the locked position with a keeper associated therewith.

Keeper 1340 is then located within locking aperture 1120 as shown in FIG. 10B. Plug 1343 of keeper 1340 is located within recess 1314 by way of an interference fit in order that keeper 1340 is secured to locking pin 1310. Keeper 1340 prevents ingress of fines and the like into locking aperture 1120.

Figure 11:
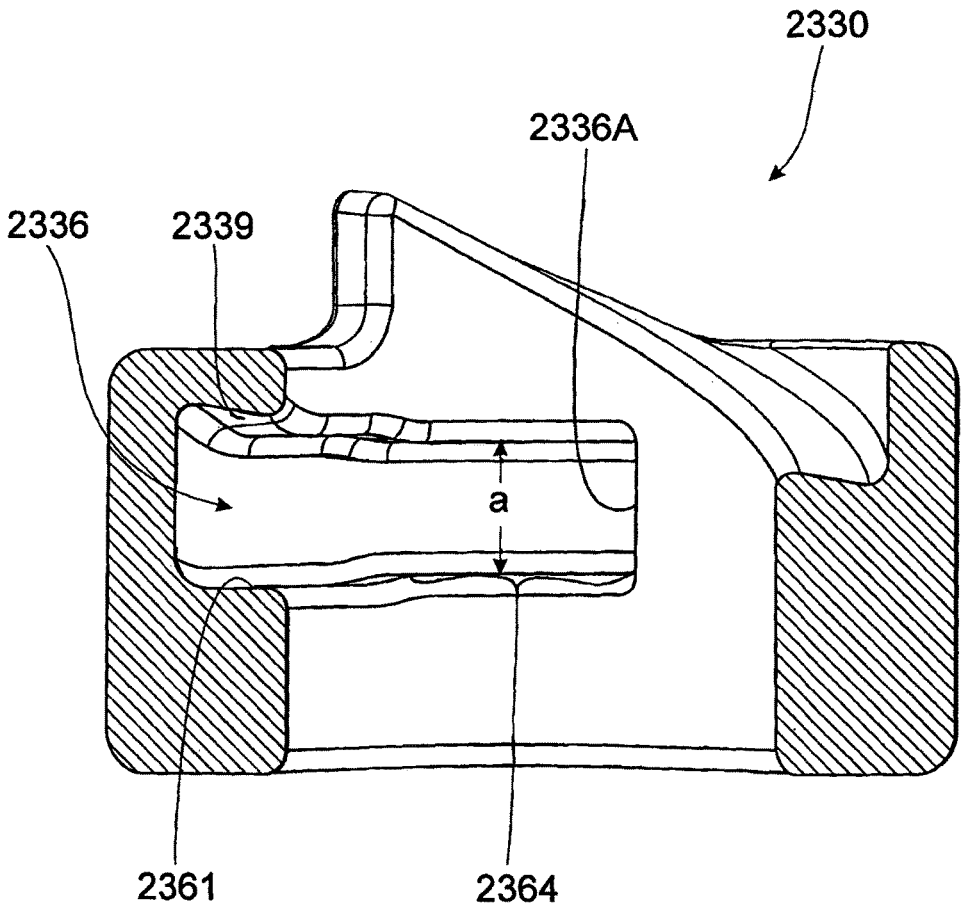
FIG. 11 shows a sectional view of a retaining member according to another embodiment of the invention.
Figure 12:
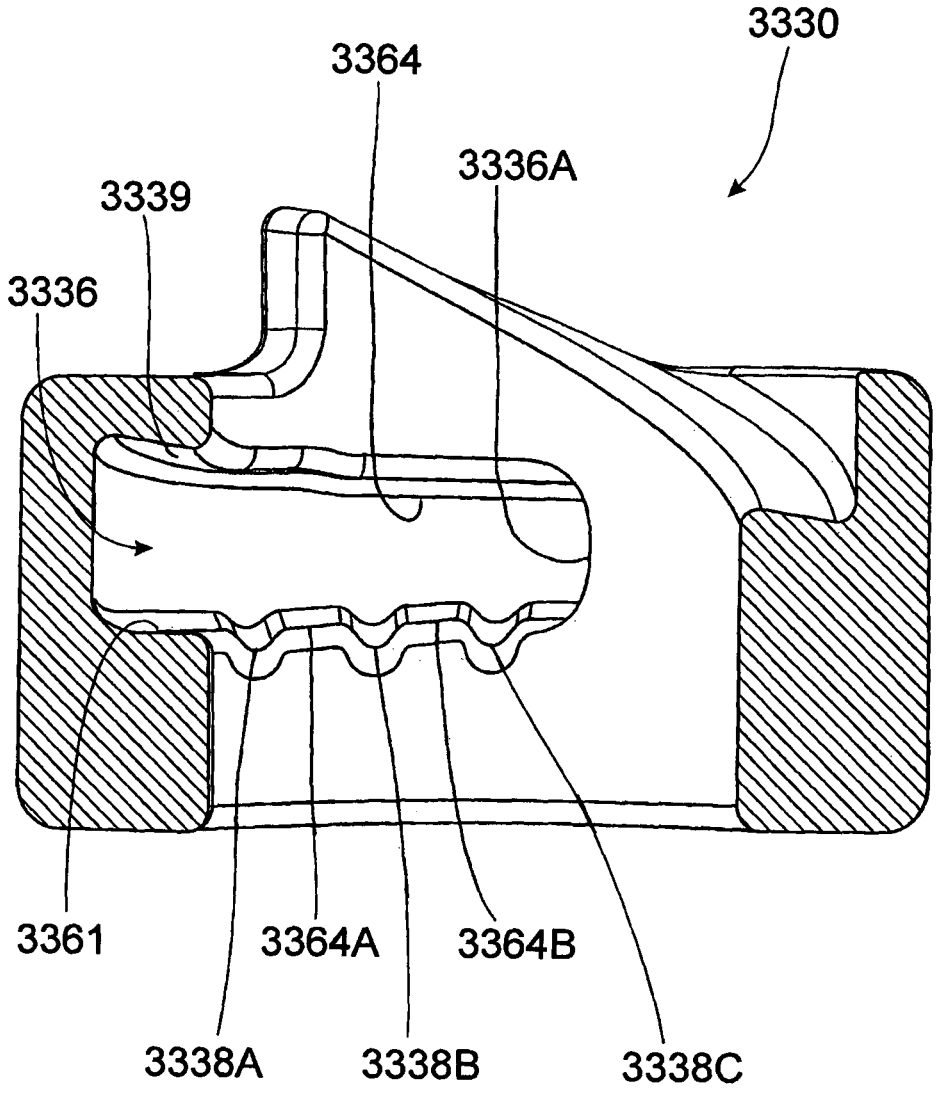
FIG. 12 shows a sectional view of a retaining member according to yet another embodiment of the invention; FIG.

FIGS. 11 and 12 show cross sectional views, similar to FIG. 4F, of alternative retaining members 2330 and 3330, respectively. Retaining members 2330 and 3330 of FIGS. 11 and 12, respectively, differ from the retaining member 1330 of FIGS. 4A to 4F in that slots 2336 and 3336, which are adapted to receive, the dowel ends 1316 of locking pin 1310, are shaped differently.

Retaining member 2330 of FIG. 11 has a narrowed section 2364 that extends from angled guide surface 2339. Slot 2336 of retaining member 2330 of FIG. 11 has no seat, such as seat 1338 of retaining member 1330 of FIGS. 4A to 4F, but rather ends in a terminal wall 2336A. Terminal wall 2336A may be squared in profile, as illustrated in FIG. 11, or may be shaped such as rounded with a diameter not greater than the width of the narrowed section 2364.

Slot 2336 is defined between guide surfaces 2339 and 2361. Part of the guide surface 2339 forms a roof of the slot 2336. Part of the guide surface 2361 forms a floor of the slot 2336. The width "a" of the slot 2336 at the narrowed section 2364 is less than the cross sectional dimension "c" of the dowel 1311 (shown in FIGS. 9A to 9C with respect to retaining member 1330 of FIGS. 4A to 4F). The width "a" of the slot 2336 along the narrowed section 2364 is measured between the roof of the slot 2336 and the floor of the slot 2336 as shown in FIG. 11.

In use, translation of the dowel 1311 of locking pin 1310 continues until the dowel ends 1316 bear against the narrowed section 2364 of slot 2336. The narrowed section 2364 is slightly narrower than the diameter of the dowel ends 1316, but wide enough to allow the dowel ends 1316 to be forced into the narrowed section 2364. That is to say that the dowel ends 1316 are forced into the narrowed section 2364 under interference.

In order to reach a locked position, locking pin 1310 is rotated axially clockwise about a longitudinal axis thereof in order to force the dowel ends 1316 into the narrowed section 2364 and, preferably to bear against terminal wall 2336A. The dowel ends 1316 resiliently deform the narrowed section 2364 in order to enter as the locking pin 1310 is axially rotated. That is, the material forming the retaining member 2330 resiliently deforms in the region of the narrowed section 2364 to allow entry of the dowel ends 1316 as described. Optionally, the dowel ends 1316 may resiliently deform in order that the dowel ends 1316 may enter the narrowed section 2364 of the slot 2336.

In the locked position, the dowel ends 1316 are received, and held under constant pressure, within narrowed section 2364 of slot 2336 of retaining member 2330. The available space around dowel ends 1316 when located in the narrowed section 2364 is reduced compared to when dowel ends 1316 are located in seat 1338 of retaining member 1330 of FIGS. 4A to 4F. This can reduce the likelihood of dowel ends 1316 seizing inside the slots 2336 of retaining member 2330 due to fines build up which is particularly useful in certain mining conditions where fines build up may be prevalent.

Turning to FIG. 12, retaining member 3330 has slot 3336 defined by guide surfaces 3361 and 3339. Slot 3336 of retaining member 3330 of FIG. 12 has a plurality of seats, namely first seat 3338A, second seat 3338B and third seat 3338C. Between adjacent pairs of seats are narrowed sections 3364A and 3364B. Upper surface 3364 opposing the narrowed sections 3364A and 3364B is tapered such that the narrowed sections 3364A and 3364B are progressively more narrowed towards terminal wall 3336A. The lower surface defined by guide surface 3361, seats 3338A-C, and narrowed surfaces 3364A and 33648 may also be tapered (as illustrated).

Part of the guide surface 3339 forms a roof of the slot 3336 and part of the guide surface 3361 forms a floor of the slot 3336. The width of the slot 3336 at the narrowed sections 3364A and 3364B is less than the cross sectional dimension "c" of the dowel 1311. (shown in FIGS. 9A to 9C with respect to retaining member 1330 of FIGS. 4A to 4F). The width of the slot 3336 along the narrowed section 3364 is measured between the upper surface 3364 of the narrowed sections and the narrowed sections 3364A and 3364B of the lower surface between adjacent seats 3338A-C.

The seats 3338A-C are formed by indentations in the lower guide surface 3361. The seats 3338A-C may be any suitable shape, but are rounded indentations in the illustrated embodiment. The radius of each seat 3338A-C is no greater than the radius of the dowel ends 1316 and, in a preferred embodiment, less than the radius of the dowel ends 1316.

In use, translation of the dowel 1311 of locking pin 1310 continues until the dowel ends 1316 are received by first seat 3338A. The adjacent narrowed section 3364 is slightly narrower than the diameter of the dowel ends 1316, but wide enough to allow the dowel ends 1316 to be forced into the narrowed section 3364A. That is to say that the dowel ends 1316 are forced into, and through, the narrowed section 3364A under interference. Once the dowel ends 1316 of locking pin 1310 pass through first narrowed section 3364A they are received by second seat 3338B. The same process occurs for the second narrowed section 3364B until the dowel ends 1316 are received by third seat 3338C.

The space for dowel ends 1316 defined by seats 3338A-C typically decreases in size such that the dowel ends 1316 are held under progressively increasing force from the first seat 3338A to the last seat 3338C. The plurality of seats 3338A-C provide a ratchet effect when locking and unlocking the locking pin 1310, with the differing resistances to passage of the dowel preferably providing a physically observable indication to an operator when the locking pin 1310 is sufficiently locked.

In order to reach a locked position, locking pin 1310 is rotated axially clockwise about a longitudinal axis thereof in order to force the dowel ends 1316 through the narrowed sections 3364A and 3364B and to sit in seat 3338C. The dowel ends 1316 resiliently deform the narrowed sections 3364A and 3364B in order to pass through as the locking pin 1310 is axially rotated. That is, the material forming the retaining member 3330 resiliently deforms in the region of the narrowed sections 3364A and 3364B to allow entry of the dowel ends 1316 as described. Optionally, the dowel ends 1316 may resiliently deform in order that the dowel ends 1316 may pass through the narrowed sections 3364A and 3364B of the slot 3336.

In the locked position, the dowel ends 1316 are received, and held under constant pressure in seat 3338C of slot 3336 of retaining member 3330. The tapering of the slot 3336, particularly in the region of tapered upper surface 3364, reduces the force required to overcome combined resistance of fines build up and interference of the dowel during removal.

FIG. 13 shows a perspective view and FIG. 14 show cross sectional view, similar to FIG. 4F, of a retaining member 4330 according to an embodiment of the invention. Retaining member 4330 of FIGS. 13 and 14 has a slot 4336 defined between guide surfaces 4339 and 4361. Part of guide surface 4339 forms a roof of the slot 4336 and part of guide surface 4361 forms a floor of the slot 4336.

Slot 4336 has a narrowed section 4364 that extends from angled guide surface 4339. The width of the slot 4336 at the narrowed section 4364, indicated as "a" in FIG. 14, is less than the cross sectional dimension "c" of the dowel 1311 (shown in FIGS. 9A to 9C with respect to retaining member 1330 of FIGS. 4A to 4F). The width "a" of the slot 4336 along the narrowed section 4364 is measured between the roof of the slot 4336 and the floor of the slot 4336 as shown in FIG. 14.

Slot 4336 of retaining member 4330 of FIGS. 13 and 14 has a single seat 4338A and ends in a terminal wall 4336A. Terminal wall 4336A, seen most clearly in FIG. 14, has two cut-out regions 4336B which increase the width of the slot 4336 adjacent the terminal wall 4336A. The width of the slot 4336 between the two cut-out regions 4336B is greater than the cross sectional dimension "c" of the dowel 1311.

In use, translation of the dowel 1311 of locking pin 1310 continues until the dowel ends 1316 bear against the narrowed section 4364 of slot 4336. The narrowed section 4364 is slightly narrower than the diameter of the dowel ends 1316, but wide enough to allow the dowel ends 1316 to be forced into the narrowed section 4364. That is to say that the dowel ends 1316 are forced into the narrowed section 4364 under interference.

In order to reach a locked position, locking pin 1310 is rotated axially clockwise about a longitudinal axis thereof in order to force the dowel ends 1316 into the narrowed section 4364 to be received by seat 4338. When located in seat 4338 at least some of the pressure on the dowel ends 1316 caused by the interference fit in the narrowed portion 4364 of the slot 4336 is relieved, but dowel ends 1316 are preferably still held under continual pressure when located in seat 4338. Typically when the dowel ends 1316 are received in seat 4338 they will also bear against terminal wall 4336A. Location of the dowel ends 1316 in seats 4338 also provides feedback to an operator rotating the dowel 1311 that the dowel ends 1316 are in a locked position.

The dowel ends 1316 resiliently deform the narrowed section 4364 in order to enter the slot 4336 as the locking pin 1310 is axially rotated. That is, the material forming the retaining member 4330 resiliently deforms in the region of the narrowed section 4364 to allow entry of the dowel ends 1316 as described. Optionally, the dowel ends 1316 may resiliently deform in order that the dowel ends 1316 may enter the narrowed section 4364 of the slot 4336.

The available space around dowel ends 1316 when held under interference in seat 4338 is reduced compared to when dowel ends 1316 are located in seat 1338 of the embodiment of the retaining member 1330 shown in FIGS. 4A to 4F. This reduces fines travelling past and building up around dowel ends 1316 when they are received in the slots 4336 which in turn reduces the likelihood of dowel ends 1316 seizing inside the slots 4336 of retaining member 4330 due to fines build up which may be prevalent when the invention is being worked in certain mining conditions.

The embodiments of the locking assembly 1300 and tooth 1100 discussed above has particular advantages when it is time to replace tooth 1100 due to wear.

The keeper. member 1340 is first removed. A tool is then used to axially rotate locking pin 1310 anti-clockwise and urge each dowel 1311 out of respective slots 1336, 2336, 3336, 4336, e.g. for retaining member 1330 shown in FIGS. 4A to 4F, each dowel 1311 is urged our of each seat 1338 and passed through narrowed section 1364. Each dowel head 1316 travels along a respective helical slot 1800 and that translation urges locking pin 1310 to begin to eject outwardly of locking aperture 1120.

An outward end of locking pin 1310 is then available in order to draw the locking pin entirely from the aligned apertures and thus remove tooth 1100 from adaptor 1200.

The ejection of locking pin 1310 from locking aperture 1120 as a consequence of a tool axially rotating locking pin 1310 as described above is particularly advantageous in circumstances where the locking pin 1310 becomes cemented within retaining passage 1237 of spigot portion 1230 of adaptor 1200 through ingress of fines and moisture. The axial rotation is sufficient to overcome the force of the cementation and partially eject the pin 1310 to provide purchase for further withdrawal. Furthermore, the taper in the main portion of the locking pin as previously described ensures that once the initial cementation is broken, the pin may be withdrawn without any further significant frictional effects between the faces of the main portion and the faces of the aperture and passage.

The excavator wear assembly of the invention and the lock assembly for securing the wear member in the form of a tooth to an adaptor avoid the need for threaded components and complex parts. Furthermore, the lock assembly avoids the need for heavy hammers and the like for mounting within the respective retaining apertures and retaining cavities. In this way, the invention provides for an effective method of releasably securing the tooth to the adaptor.

Throughout the specification the aim has been to describe the invention without limiting the invention to any one embodiment or specific collection of features. Persons skilled in the relevant art may realize variations from the specific embodiments that will nonetheless fall within the scope of the invention.

It will be appreciated that various other changes and modifications may be made to the embodiment described without departing from the spirit and scope of the invention.

In this specification, where different embodiments shire identical features, common reference numbers are used to identify those identical features.

The invention claimed is:

1. A lock assembly for an excavator wear assembly, the lock assembly comprising:

a locking pin which is operable to extend through a portion of at least two components of the excavator wear assembly when those components are mounted together to prevent separation of those components, the locking pin having at least one dowel extending outwardly therefrom;

an integrally formed retaining member having a slot formed therein, the slot having opposed sides that are part of the retaining member, and wherein the slot is adapted to receive the dowel;

wherein a narrowed section of the slot between the opposed sides is narrowed to a width that is less than a cross sectional dimension of a part of the dowel received in the narrowed section of the slot.

2. The lock assembly of claim 1, wherein the slot has a seat that receives the dowel after passing through the narrowed section, and wherein the seat has a width which is larger than the width of the narrowed section of the slot.

3. The lock assembly of claim 2, wherein the seat is sized smaller than the part of the dowel passing through the narrowed section such that the dowel is held under pressure when located in the seat.

4. The lock assembly of claim 2, wherein the slot has a plurality of seats that define at least one narrowed section.

5. The lock assembly of claim 4, wherein the slot is tapered and the seats decrease in size towards the narrow end of the tapered slot.

6. The lock assembly of claim 1, wherein the retaining member has a cylindrical aperture through which the locking pin is received, and wherein the slot is located in a wall defining the aperture of the retaining member.

7. The lock assembly of claim 6, wherein the narrowed section of the slot is narrowed axially with respect to the cylindrical aperture.

8. The lock assembly of claim 1, wherein the slot has a terminal wall and one or more cut-outs located in a junction of the terminal wall with an upper and/or lower guide surface of the slot, and wherein the slot has a seat located near the terminal wall of the slot such that when the dowel of the locking pin is located in the seat a portion of the dowel engages with a portion of the terminal wall.

9. The lock assembly of claim 1, wherein the dowel of the locking pin resiliently deforms the retaining member when the dowel is forced through the narrowed section of the slot of the retaining member.

10. The lock assembly of claim 1, wherein the dowel of the locking pin resiliently deforms when it is forced through the narrowed section of the slot of the retaining member.

11. An excavator wear assembly comprising an excavator wear member releasably retained to an adaptor by a lock assembly according to claim 1.

12. An excavator wear assembly comprising:

an excavator wear member having a socket cavity and locking aperture extending through a side wall of the excavator wear member, the locking aperture having a receiving passage and a retaining recess;

an adaptor having a spigot portion operable to be located within the socket cavity of the excavator wear member when the excavator wear member and the adaptor are mounted together, and the adaptor having a retaining passage;

a locking pin having at least one dowel extending outwardly therefrom; and an integrally formed retaining member located, or operable to be located, within the retaining recess of the locking aperture, the retaining member having a slot formed therein, the slot having opposed sides that are part of the retaining member, the slot being adapted to receive the dowel, and a narrowed section of the slot between the opposed sides is narrowed to a width that is less than a cross sectional dimension of a part of the dowel received in the narrowed section of the slot;

wherein the locking pin is operable to be located through the locking aperture of the excavator wear member and through the retaining passage of the adaptor when the excavator wear member and the adaptor are mounted together to prevent separation thereof, and wherein the slot of the retaining member is adapted to receive the dowel of the locking pin such that the dowel is forced into the narrowed section of the slot.

13. The excavator wear assembly of claim 12, wherein the slot has a seat that receives the dowel after passing through the narrowed section, and wherein the seat is sized smaller than the part of the dowel passing through the narrowed section such that the dowel is held under pressure when located in the seat.

14. The excavator wear assembly of claim 13, wherein the slot has a plurality of seats that define at least one narrowed section.

15. The excavator wear assembly of claim 12, wherein the slot has a terminal wall and one or more cut-outs located in a junction of the terminal wall with an upper and/or lower guide surface of the slot.

16. The excavator wear assembly of claim 12, wherein the dowel of the locking pin resiliently deforms the retaining member when the dowel is forced through the narrowed section of the slot of the retaining member.

17. The excavator wear assembly of claim 12, wherein the dowel of the locking pin resiliently deforms when it is forced through the narrowed section of the slot of the retaining member.

18. An excavator wear member comprising:

a locking aperture extending through a side wall of the excavator wear member, the locking aperture having a receiving passage; and an integrally formed retaining member located, or operable to be located, within the locking aperture, the retaining member having a slot formed therein, the slot having opposed sides that are part of the retaining member, and a narrowed section that is narrowed to a width that is less than a cross sectional dimension of a part of a dowel of a locking pin that is operable to be received in the narrowed section of the slot when the excavator wear member is secured to another component of an excavator wear assembly by the locking pin.

19. The excavator wear member of claim 18, wherein the integrally formed retaining member is itself integrally formed within the locking aperture.

20. The excavator wear member of claim 18, wherein the slot has a seat that receives the dowel after passing through the narrowed section, and wherein the seat is sized smaller than the part of the dowel passing through the narrowed section such that the dowel is held under pressure when located in the seat.

21. The excavator wear member of claim 20, wherein the slot has a plurality of seats that define at least one narrowed section.

22. The excavator wear member of claim 18, wherein the slot has a terminal wall and one or more cut-outs located in a junction of the terminal wall with an upper and/or lower guide surface of the slot.

23. The excavator wear member of claim 18, wherein the retaining member is resiliently deformable.

* * * * *